US009567816B2

(12) United States Patent
Bertelsen

(10) Patent No.: US 9,567,816 B2
(45) Date of Patent: Feb. 14, 2017

(54) LOW MAINTENANCE IRON ROUGHNECK SYSTEM WITH REPLACEABLE MODULAR COMPONENTS THEREOF

(71) Applicant: Jeffrey Lee Bertelsen, Coldspring, TX (US)

(72) Inventor: Jeffrey Lee Bertelsen, Coldspring, TX (US)

( * ) Notice: Subject to any disclaimer, the term of this patent is extended or adjusted under 35 U.S.C. 154(b) by 311 days.

(21) Appl. No.: 14/244,080

(22) Filed: Apr. 3, 2014

(65) Prior Publication Data

US 2014/0299376 A1 Oct. 9, 2014

Related U.S. Application Data

(60) Provisional application No. 61/807,843, filed on Apr. 3, 2013.

(51) Int. Cl.
*E21B 19/20* (2006.01)
*E21B 19/16* (2006.01)

(52) U.S. Cl.
CPC ..... *E21B 19/168* (2013.01)

(58) Field of Classification Search
USPC ..... 175/57, 24
See application file for complete search history.

(56) References Cited

U.S. PATENT DOCUMENTS

2004/0049905 A1* 3/2004 Jansch ..... E21B 19/164 29/428
2005/0047884 A1* 3/2005 Belik ..... E21B 19/00 408/234
2007/0068669 A1* 3/2007 Lesko ..... E21B 19/163 166/77.51
2009/0314137 A1* 12/2009 Perez ..... E21B 19/165 81/57.16
2012/0111155 A1* 5/2012 Holen ..... E21B 19/163 81/57.35

* cited by examiner

*Primary Examiner* — Taras P Bemko
(74) *Attorney, Agent, or Firm* — Matthew J. Lattig; Charter IP, LLC

(57) ABSTRACT

The example automated roughneck system herein includes a base module, a removable spinner module for spinning pipe to connect or disconnect drill pipes at threaded interfaces, and a removable torque module for torqueing drill pipe. The spinner module is adapted to automatically self-center itself around a drill pipe and adjust to a varied range of drill pipe diameters. A centering device of the torque module automatically senses drill pipe of varied diameters and moves around the drill pipe until the spinner and torque modules are centered on the drill pipe. An extension module of the system is connected between the base module and the spinner and torque modules. A plurality of arms thereon are adapted to be extended and retracted from/to the extension module to move the spinner and torque modules toward and away from the base module. Each of these modules are remotely controlled.

25 Claims, 18 Drawing Sheets

LOW MAINTENANCE IRON ROUGHNECK SYSTEM WITH REPLACEABLE MODULAR COMPONENTS THEREOF

CROSS-REFERENCE TO RELATED APPLICATION

The present application claims the benefit under 35 U.S.C. §119(e) of U.S. Provisional Patent Application No. 61/807,843 to the inventor, filed Apr. 3, 2013, the entire contents of which is hereby incorporated by reference herein.

BACKGROUND

1. Field

Example embodiments generally relate to a low maintenance iron roughneck system with replaceable modular components thereof.

2. Related Art

Conventionally at an oil rig site, an iron roughneck is employed on rig floor where space is limited for drilling, drill pipe make-up and break out operations around the well center. FIGS. 1 through 4 illustrate a well known prior art iron roughneck, the ST-80C Iron roughneck manufactured by National Oilwell Varco®. Typically, the ST-80C requires a number of human operators to handle pipe make-up and break-out operations around the well center. The iron roughneck is typically installed on the drill floor utilizing either a single floor mounted socket or a floor mounted bearing an upper mast 30 attachment as shown in FIGS. 1 and 3 for elevated storage. With the taller column mast 30, the ST-80C is able to be stored above the crew, clearing drill floor space as is known.

One operator is at the hydraulic control station 50, while two (2) or more operators manipulate the scissor arm 35 which is attached between the mast 30 and a spinner 10A and torque wrench 20 (torque module) that is used for the drill pipe make-up and break out operations around the well center. This equipment is quite heavy (total assembly weight is about 7800 lbs) and can be extremely dangerous on the drill floor. For example, manual rotation of the conventional iron roughneck by human operators is required. The roughneck has to be muscled or pushed to rotate the unit in to place around the well center. The roughneck also has multiple levers that do different functions. Conventional roughneck systems such as is shown in FIGS. 1-4 allow the operator(s) to pull any lever or do any function at any time, even if it is dangerous to the operator or the roughneck; there are no safety interlocks in place. Further, installing the roughneck onto the drill pipe invites multiple hazards to personnel. With conventionally designed roughnecks, one or more operators are standing next to the roughneck while visually attempting to center the clamping device on the drill pipe.

Moreover, the roughneck needs frequent daily and scheduled maintenance, and it is prone to breakage. If one part of the roughneck is damaged, the entire system is out of order, costing significant downtime. There are also a number of zerks that are used to apply grease to the moving parts of the roughneck. The grease is used to try and keep contaminates out of the moving parts, which could cause damage. On the current roughnecks if this periodic maintenance is not performed, component damage will ensue. Daily downtime must also be scheduled for grease zerk maintenance.

Additionally, various diameters of piping are used in order to extract fossil fuels from deep beneath the earth's crust.

The roughneck must be able to torque and spin various sections of different diameter pipes during the drilling process. The current roughnecks require that clamp dies be constantly changed to switch from one diameter of pipe to another. The changing or reconfiguring of the clamp dies takes time, slowing down the drilling process. The time it takes, "connection time", delays extraction of oil and is a significant cost to drillers.

Accordingly, a site will typically have a number of different sized drill slips or drill collars and pipe handling devices to account for the different diameter piping used; i.e., a different sized drill slip or casing slip is used with each change in pipe diameter. Often this can mean up to 5 to 7 different diameter pipe handling devices such as slips, drill collars, tongs, as well as wasted time changing between these devices or changing the devices to different pipe sizes.

There are two, basic, conventional clamping methods used to hold pipe during torque operations on the pipe. The drill pipe is torqued at every tool joint or pipe joint, and a joint is present on drill pipe at about every thirty feet; thus requiring a torque operation at every joint. Drilling operations typically range from about 10,000 to 20,000 in depth, so hundreds of these torque operations are performed during the drilling process. The pipe must be clamped each time a torque operation is performed thereon.

One clamping method employs two clamp dies (clamps) placed directly across from each other. There is a problem if the pipe is not centered between the dies, the pipe can be damaged or slip out of the clamps, where one clamp die is located on each side of the pipe in a holder. This design applies all of the force in a small area about 1" by 5" on either side of the pipe; if the applied force is too high in this small area it will cause the pipe to become deformed, or "egg-shaped", damaging the pipe. This setup also will occasionally cause the pipe to hit the edge of the dies, causing pipe damage on all pipes that are small or larger than the fixed radius between the clamps. Either of these conditions results in lost time due to the discarding of the pipe, or increased rate of pipe joint degradation which increases operating costs.

The second conventional clamping method employs three (3) fixed clamp dies (clamps) located in a holder set at a static mid-range radius in an effort to try and clamp different diameter pipes and distribute the force over a greater area. On pipe having a smaller diameter (and hence smaller radius), and due to the preset radius of the clamp dies in the holder, the smaller pipe only makes contact on the inside edge of the clamp dies only. Conversely, if the pipe diameter (and hence radius) is larger, the outside dies in the clamp holder will contact on the outside edge only. This becomes an issue, as pressure is not distributed evenly on the clamps during the torque operations.

In both design cases, if the pipe diameter changes, inserts must be either added or removed from the fixed jaw clamps in an effort to compensate for the radius change effect. Further, as the clamp dies provide only two points of pressure on the pipe, and not a uniform pressure, there is the possibility of slippage and/or deformation of the pipe under intense forces (typically in upwards of 100,000 ft-lbs) applied by the clamps to hold the pipe in place.

Conventionally, the torque applied to these clamps is applied by way of a cylinder with piston rod that is part of a torque module. The torque cylinder design is limited to 32 to 37 degrees of torque head rotation maximum in the conventional torque module. This is due to what is known as a cam over effect caused by the cylinder being fixed at one point to the back of the main body of the torque module support frame, so as the torque head rotates about the center of the pipe, the cylinder pushes the upper torque head around a radius or torque arc about the center of the drill pipe with the clamps engaged on the pipe, rotating the pipe. The rotational arc of the torque head will rotate to about 37 degrees maximum. At that point, the cylinder piston rod end reaches a point on the torque arc that is straight across or below a base attachment point where the cylinder attaches to the torque module frame. At this point, the cylinder can no longer be returned to its starting position around the torque arc. Instead, the cylinder will attempt to come straight across the torque arc and not follow the arc back around when it is returned. This will lock up or damage the torque head, so conventional torque modules are design limited to rotating the torque head up to a maximum of about 35 degrees, so as to prevent the cam over effect from happening.

Also this design has a major issue with the force angle changing from 90 degrees to less than 90 degrees as the cylinder in the torque module rotates around the torque arc. Torque is measured with the force applied at 1 ft and 90 degrees to the center of rotation. If the force angle increases or decreases from 90 degrees, the torque is decreased by the sine of the angle. So the torque accuracy of this conventional torque module design is limited, it will never yield a true torque and it cannot be compensated for due to the fact the operator does not know the required amount of rotation to achieve the desired torque.

This conventional hydraulic cylinder design in a torque module is also limited on break and make operations. The make operation (torqueing a pipe joint) is accomplished using the retraction side of the cylinder; the break operating is accomplished using the extension side of the cylinder. Because the break operation is performed using the extension side of the cylinder, the break operation becomes a two-step process. This is due to the fact that a cylinder puts out less force in a retract operation then it does in an extension operation due to the loss of area on the rod side of the cylinder. This limitation will cause what is referred to as the "breakout operation" (i.e., disconnect or breaking of the pipe joints one from the other) to be a two-step torque process instead of a single step. To breakout, the torque head of the conventional torque module with cylinder initially has to rotate to 35 degrees, then the clamp is applied to the pipe, and finally the clamped pipe under torque is rotated back breaking the tool joint apart. This two step torque process in the conventional torque module takes twice as long, as compared to a torque module that rotates from a central or neutral point and will rotate CCW or CW, for a single-step process. Moreover, the 37 degree limitation can also cause the torque process to require multiple movement steps, as a torque head rotation may require greater than a 37 degree movement on the pipe with the clamp.

SUMMARY

An example embodiment is directed to an automated roughneck system. The system includes a base module, a removable spinner module for spinning pipe to connect or disconnect drill pipes at threaded interfaces, the spinner module configured to automatically self-center itself around a drill pipe and to automatically adjust to a varied range of drill pipe diameters, a removable torque module for torqueing drill pipe, the torque module including a centering device which automatically senses drill pipe of varied diameters and moves around the drill pipe until the spinner module and torque module are centered on the drill pipe, and an extension module connected between the base module and the spinner and torque modules, the extension module including a plurality of arms adapted to be extended therefrom and retracted thereto so as to move the spinner and torque modules toward and away from the base module. Each of the base, spinner, torque and extension modules are remotely controlled.

Another example embodiment is directed to an automated roughneck system, the system including a base module, a removable spinner module for spinning pipe to connect or disconnect drill pipes at threaded interfaces, the spinner module configured to automatically self-center itself around a drill pipe and to automatically adjust to a varied range of drill pipe diameters, the spinner module further including a pair of roller block assemblies arranged in opposite facing relation to one another with an opening there between for receiving drill pipe vertically therethrough, each roller block assembly laterally movable in unison into the opening under hydraulic power toward one another for pipe spinning and clamping operations into and out of the opening away from each other, The system further includes a removable torque module for torqueing drill pipe to make-up or break-out the pipe, the torque module including a centering device which automatically senses drill pipe of varied diameters and moves around the drill pipe until the spinner module and torque module are centered on the drill pipe, and an extension module connected between the base module d the spinner and torque modules, extension module including a plurality of arms adapted to be extended therefrom and retracted thereto so as to move the spinner and torque modules toward and away from the base module. Each of the base, spinner, torque and extension modules are remotely controlled.

Another example embodiment is directed to an automated roughneck system, the system including a base module, a removable spinner module for spinning pipe to connect or disconnect drill pipes at threaded interfaces, the spinner module configured to automatically self-center itself around a drill pipe and to automatically adjust to a varied range of drill pipe diameters, and a removable torque module for torqueing drill pipe to make-up or break-out the pipe, the torque module configured to automatically self-center itself around a drill pipe and to automatically adjust to a varied range of drill pipe diameters, the torque module including at least two clamp cylinders, each in opposed facing relation to the other, with an opening provided through the torque module and between the opposed clamp cylinders to accommodate a drill pipe vertically therethrough, each clamp cylinder including a front block laterally movable into and out of the opening via a piston action provided to it by a piston cylinder within the clamp cylinder, each front block having a set of pipe grip fingers affixed thereto for engaging the pipe in the opening, The system further includes an extension module connected between the base module and the spinner and torque modules, the extension module including a plurality of arms adapted to be extended therefrom and retracted thereto so as to move the spinner and torque modules toward and away from the base module. Each of the base, spinner, torque and extension modules are remotely controlled.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As to be described hereafter, an example embodiment is directed to a greaseless, automated, low maintenance iron roughneck system with detachable modular components thereof. The system utilizes a modular arrangement of spinner, torque and base modules with quick disconnects at modular interfaces to speed up servicing times. The use of double-sealed bearings and o-rings in modules of the system renders the system impervious to salt exposure and eliminates zerks that would necessitate greasing at regular intervals, thus eliminating extensive servicing downtime. The system employs hydraulic over hydraulic control interlock logic for improved safety, eliminating sparck, EMI & electrical issues, providing robust environment-tolerant interfaces and no Class 1 Div 1 constraints, with a remote operator control console pedestal provided outside the hazard zone to control the system, and operating on a DC battery.

Figure 1:
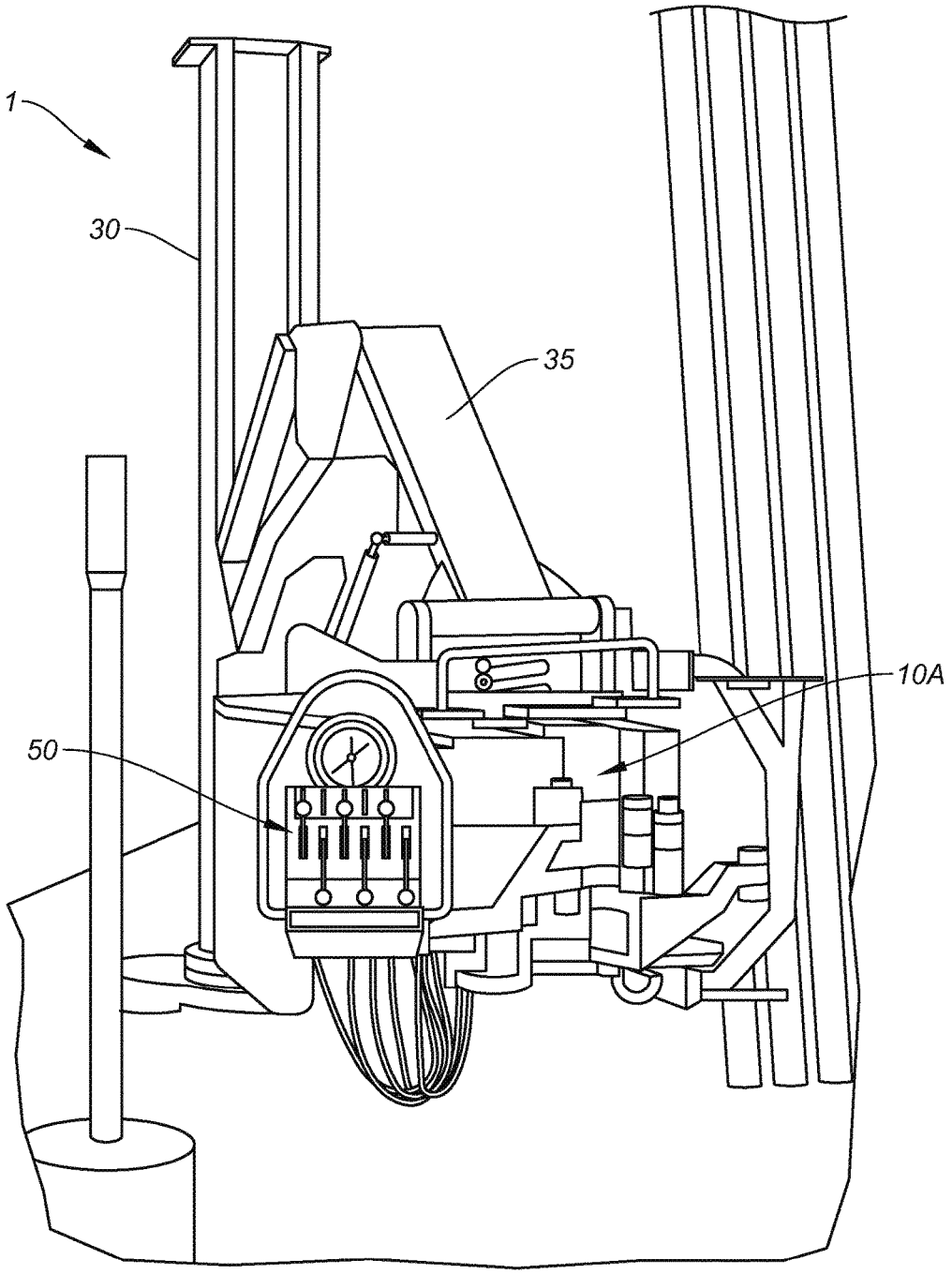
FIG. 1 (Prior Art)
FIG. 1 is a perspective view of a prior art roughneck system installed on a well floor.
Figure 4:
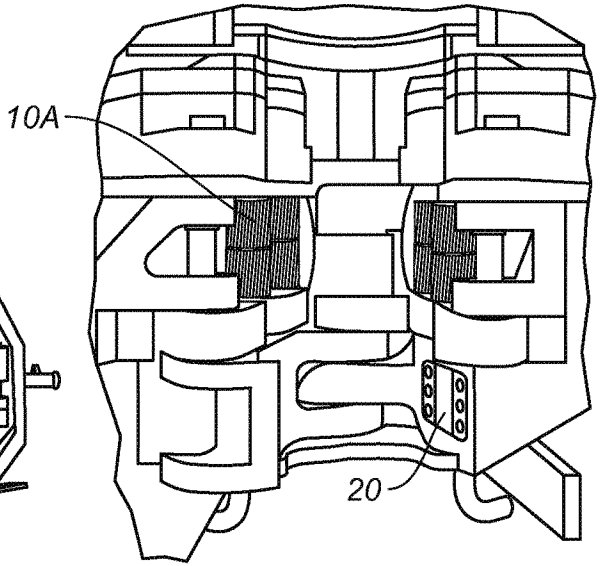
FIG. 4 (Prior Art)
FIG. 4 is a partial front view showing the spinner and torque wrenches of the system in FIG. 1 used for pipe make-up and break out operations around a well center.
Figure 3:
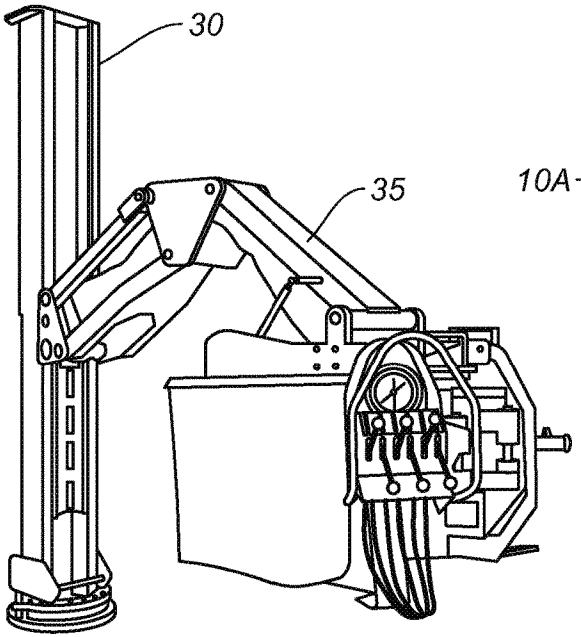
FIG. 3 (Prior Art)
FIG. 3 is perspective view of the prior art roughneck system of FIG. 1 illustrating constituent components thereof.
Figure 2:
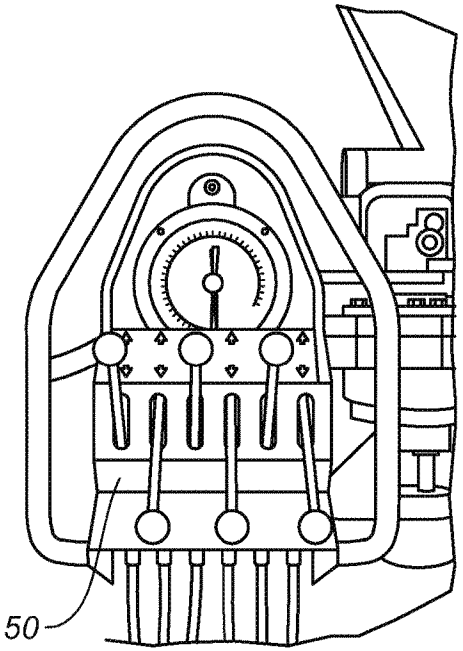
FIG. 2 (Prior Art)
FIG. 2 is a hydraulic control station of the prior art roughneck system in FIG. 1.
Figure 5:
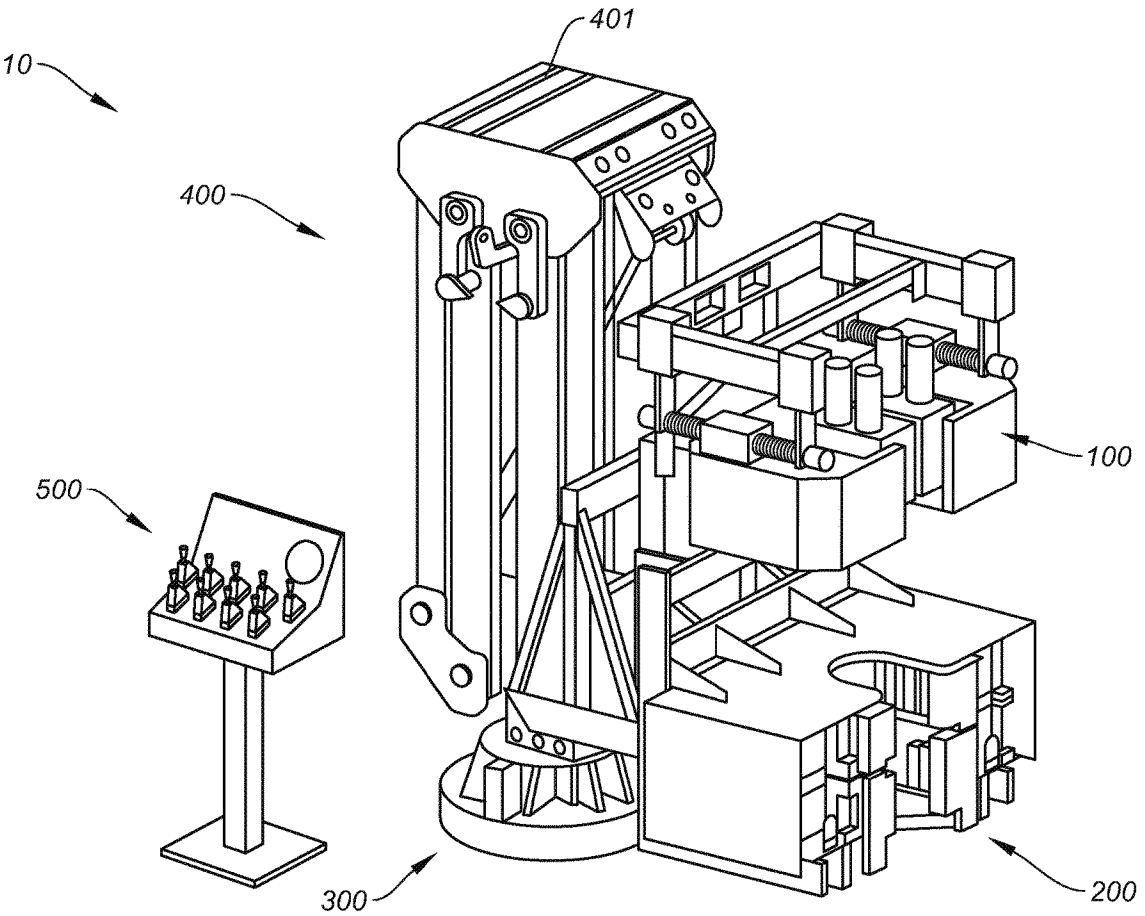
FIG. 5 is a perspective view of a greaseless, automated, low maintenance iron roughneck system with detachable modular components thereof, according to an example embodiment.
Figure 6:
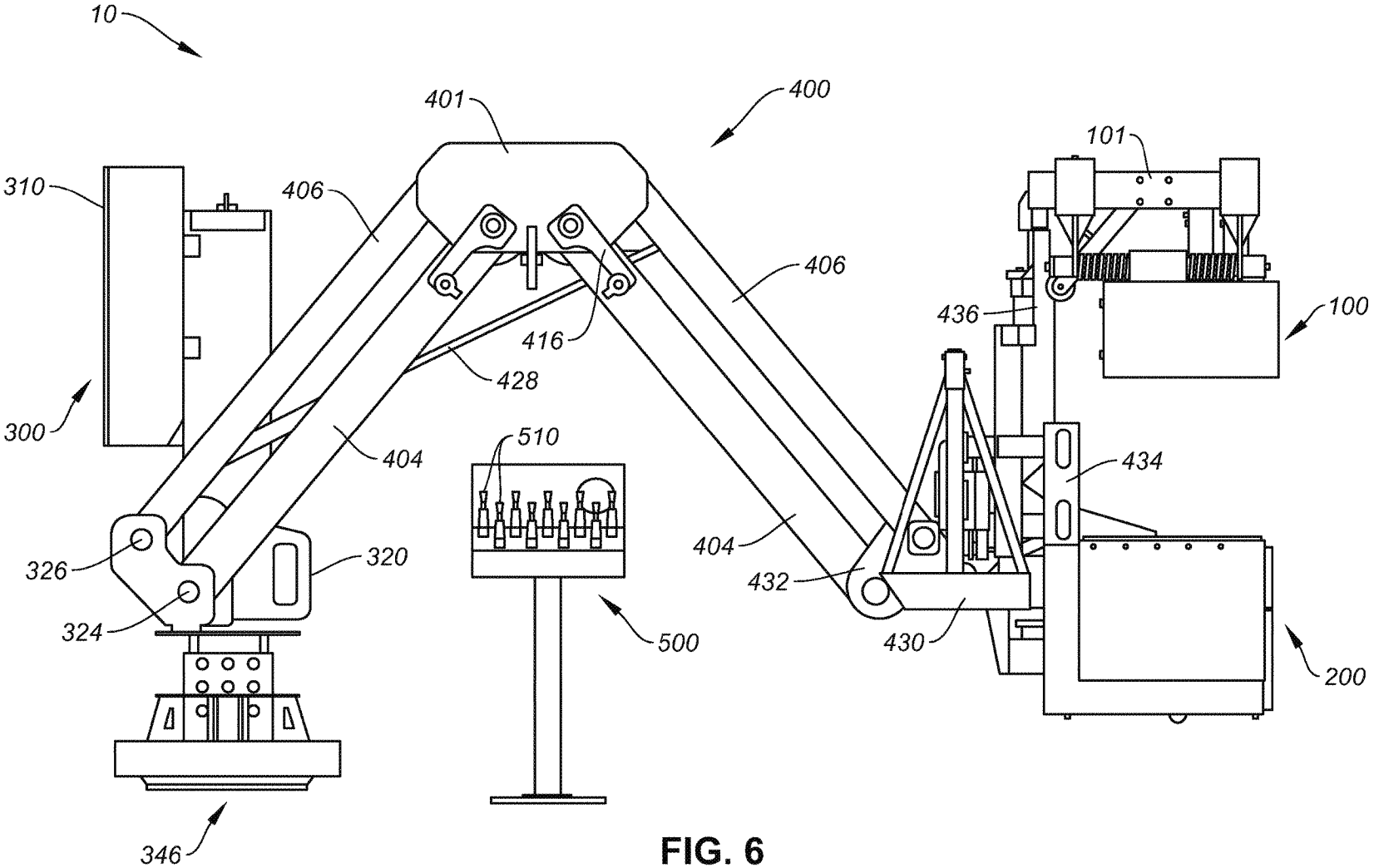
FIG. 6 is the system of FIG. 5 in an extended profile.
Figure 7:
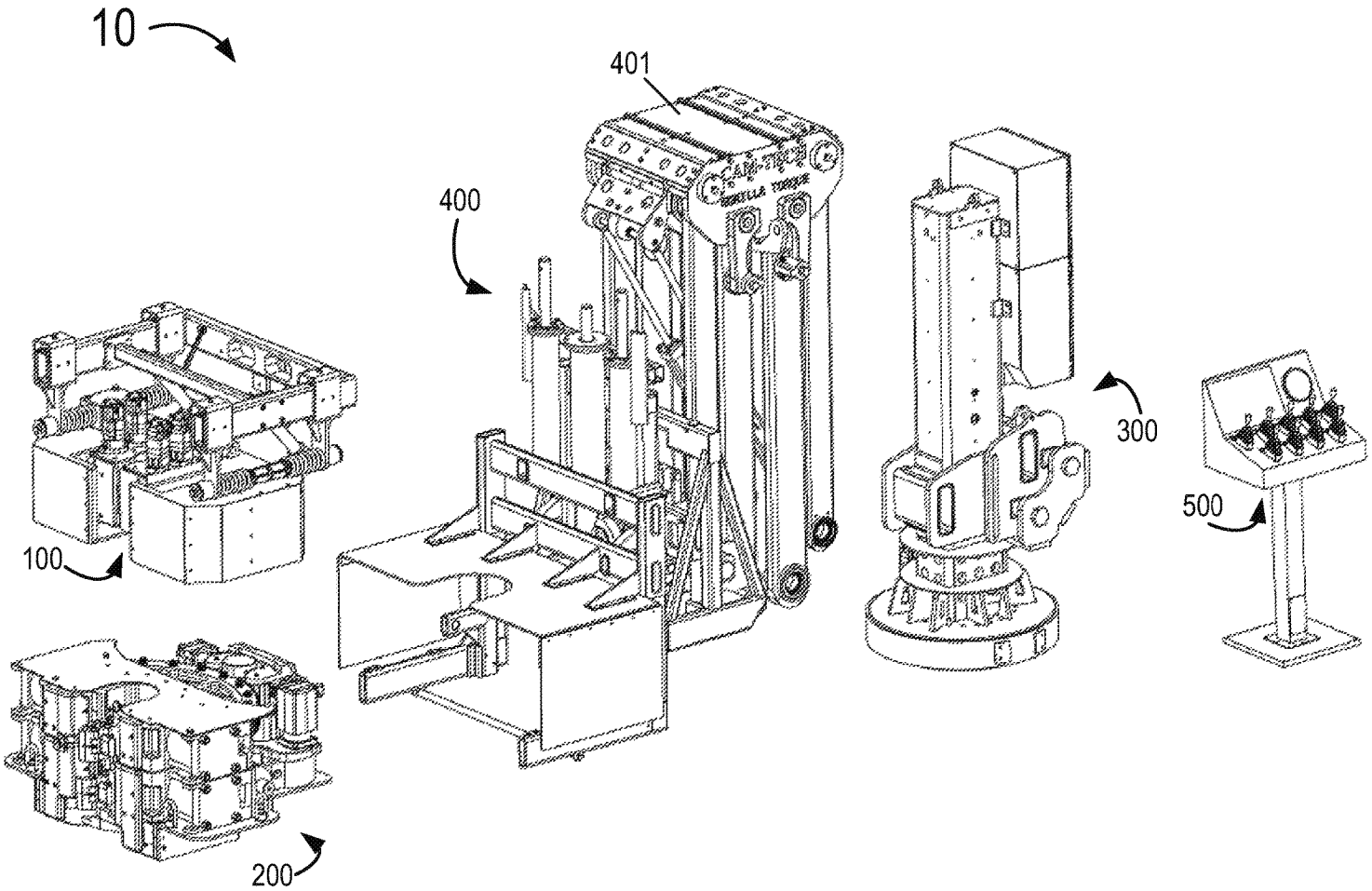
FIG. 7 is a partial exploded view showing the principal components of the system of FIG. 5 with the extension module in a retracted state.
Figure 8:
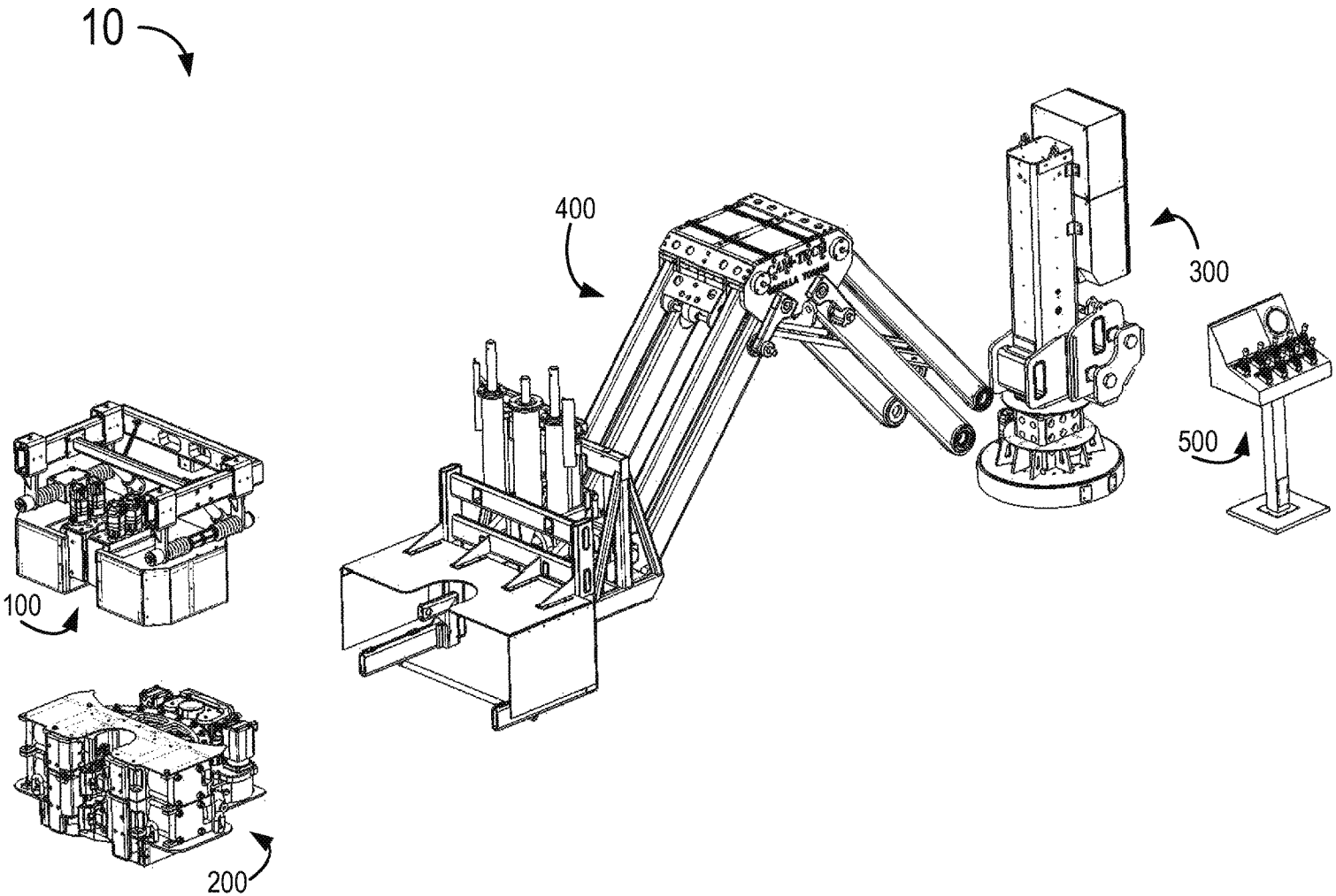
FIG. 8 is a partial exploded view showing the principal components of the system of FIG. 5 with the extension module in an extended state.

FIG. 5 is a perspective view of a automated, low maintenance iron roughneck system with detachable modular components thereof, according to an example embodiment; FIG. 6 is the system of FIG. 5 in an extended profile; FIG. 7 is a partial exploded view showing the principal components of the system of FIG. 5 with the extension module in a retracted state; and FIG. 8 is a partial exploded view showing the principal components of the system of FIG. 5 with the extension module in an extended state.

Referring to FIGS. 5-8, system 10 comprises a spinner module 100, torque module 200, base module 300, extension module 400, and operator console 500 from which hydraulic controls for the system 10 are performed remotely at the operator console 500. In designing system 10, design objectives to maximize in providing best value to the operator, taken from oil industry worker feedback, included reliability, operator friendliness, down time minimization, ease of repair and low repair costs. The design criteria were driven by the maintenance criteria used for space vehicles and limited access technologies.

Accordingly, an automated roughneck system having a modular design with low maintenance was paramount in achieving these objectives. Additionally, the system's extension module 400 moves laterally across the well center with a completely flat trajectory (not up or down). Thus, the height of the working surface does not change during arm movement in or out as the extension module 400 goes from retracted to extended positions. This reduces the time of getting the spinner 100 and torque 200 modules of the roughneck system 10 into position.

As will be described in greater detail hereafter, and referring to FIG. 6 in general, the extension module 400 employs a plurality of paired sets of extension arms 404, 406 that are each respectively connected at their upper ends to selected internal components within a central hub 401 of the extension module 400; these paired sets of forward and rearward extension arms 404 (inner) and 406 (outer) move in unison by virtue of a set of dual timing gears provided within the central hub 401, so as to ensure that both sets of spaced forward extension arms 404, 406 (connected between central hub 401 of the extension module 400 and supporting structure for the spinner module 100 and torque module 200, see an A-frame 430 in FIG. 6 for example, and the paired sets of spaced rearward arms 404, 406 (connected between central hub 401 and a bushing 320 on the base module 300) extend at the same rate. The lower ends of the forward extension arms 404, 406 on extension module 400 are thus connected to the A-frame 430, which in turn is connected to a torque module frame 434 that is designed to secure the torque module 200 thereon and also to support the spinner module 100 in an elevated state above the torque module 200. The paired sets of rearward extension arms 404, 406 are connected on either side of the base module 300 via connecting pins 324, 326 of an arm connector unit mounted to a bushing 320 that is configured to move vertically up and down under hydraulic control on a base column within base module 300. A plurality of spring cartridges 436 attached to the torque module frame 434 are oriented vertically on the torque module frame 434 so as to support a suspension frame 101 thereon, which in turn suspends spinner module 100 there from.

Additionally as to be described in further detail hereafter, the extension module 400 as shown in its extended position in FIG. 6 employs a number of torsion rods (not shown) arranged within the central hub 401 which cooperate with lever arms 416 attached on the outer side surfaces of the inner extension arms 404 to provide a counter retraction force to the extension forces created as the forward extension arms 404, 406 extend across their range carrying the weight of the spinner module 100 and torque module 200 present at the distal A-frame 430 and torque module frame 434. These retraction forces counter the extension forces such that the use of the torsion rods allows the extension module 400 to extend from its retracted state with only 100 to 400 lbs. of force.

Further, the system 10 is configured to provide an evenly distributed clamping force on the pipe with both the spinner and torque modules 100, 200. This avoids undesirable egging or chewing of the pipe which can often occur with conventional clamping, and avoids the pipe from becoming inadvertently dislodged while spinning or torqueing during make-up or break-out evolutions.

System 10 also includes powered rotation of the base module 300 as well as coarse and fine vertical height adjustment in the base module 300 for the extension module 400. The coarse vertical height adjustment is preset, thus only fine vertical height adjustment is required for the base module 300 to get on the pipe with the spinner and torque modules 100, 200 by way of the extension module 400. There is also powered mouse hole tilt adjustment of +/−10 degrees for performing torque operations at the mouse hole, which is used to make up drill pipe in 90 foot sections.

System 10 provides for substantial design flexibility, as it employs the same mounting flange as the ST80, has a spinner module 100 that can automatically accommodate or adjust to any pipe diameter from 3½" to 10", and a torque module 200 that can automatically accommodate or adjust to any pipe diameter from 4-10". As the spinner and torque modules 100, 200 are under hydraulic control, they are also self-positioning or self-centering on the pipe. Specifically, as will be detailed hereafter, system 10 provides for (a) automated centering of the roughneck system on the pipe, (b) automated return to center of the torque stroke, and (c) automated pipe diameter size adjustment for spinner and torque modules.

Moreover, hydraulic control is provided with safety interlock logic. For example, the interlocks place safety first, and are designed based on industry experience. The operator console 500 may include a display that has a green light which signifies a current operation, a yellow light for an available operation, and a red light for a locked-out operation (e.g., a clamping force during torqueing versus spinning). The interlocks thus prevent both tool damage and material damage.

All hydraulic over hydraulic system control components and all safety interlocks are contained in a hydraulic control box 310 which is attached to the base module 300, as shown in any of FIGS. 6-8. The hydraulic over hydraulic interlock system is a manifold located in the control console 500 that operates like a programmable controller. The manifold is a unique design for the roughneck system 10 and operates using a series of low pressure control valves in the manifold that turn the high pressure hydraulic supply lines to the torque motors and actuation cylinders in the spinner module 100 and torque module 200 on and off, depending on what functions are allowed to work or not work at the same time. The hydraulic over hydraulic interlock system serves as a safety system to protect both operator and equipment, For example, if a control lever 510 (FIG. 6) such as the torque handle is engaged, then all other functions on the roughneck system 10 are disabled; thus any of the remaining control levers 510 on the operator console 500 can be moved by the operator, but nothing will happen. The low pressure control valves are actuated by the movement of the control levers 510, automatically providing a safety interlock that prevents the operator from doing certain combinations of multiple functions on the system 10 that could damage the system 10 or endanger the operator. The only electrical source for system 10 is a 5 volt DC battery which operates the operator console 500 outside of the hazard zone on milliamps. Accordingly, the operator console 500 thus has a series of control levers 510 (FIG. 6) that permits remote hydraulic control of corresponding control valves or associated devices and safety interlocks within control box 310 which are designed to operate each of the spinner module 100, torque module 200, base module 300 and extension module 400. This adds to the safety factor of system 10, as operators may remain out of the hazard zone during drilling operations.

Figure 9:
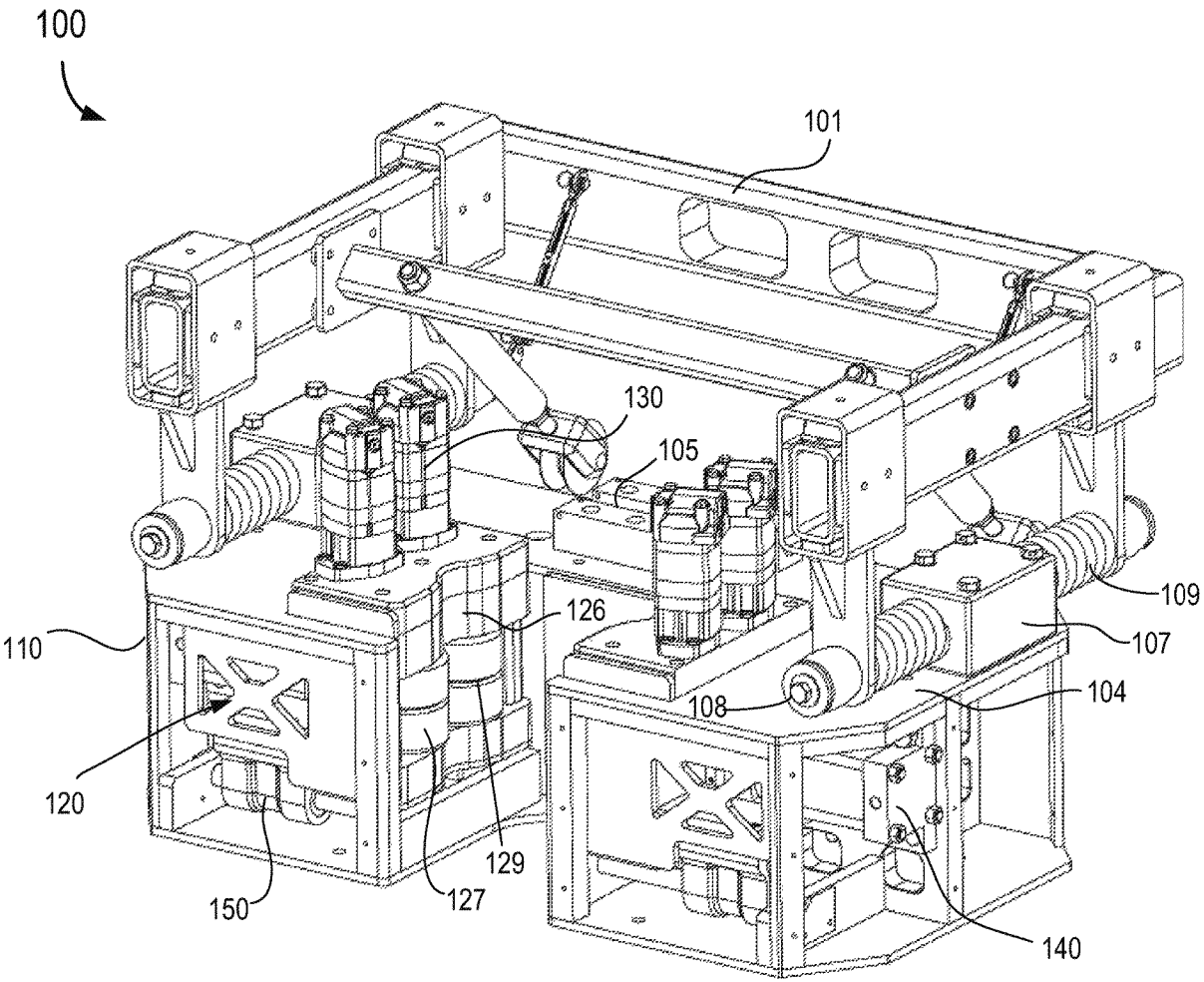
FIG. 9 is a perspective view of the spinner module of the system as shown in any of FIGS. 5-8 to illustrate constituent components thereof.
Figure 10:
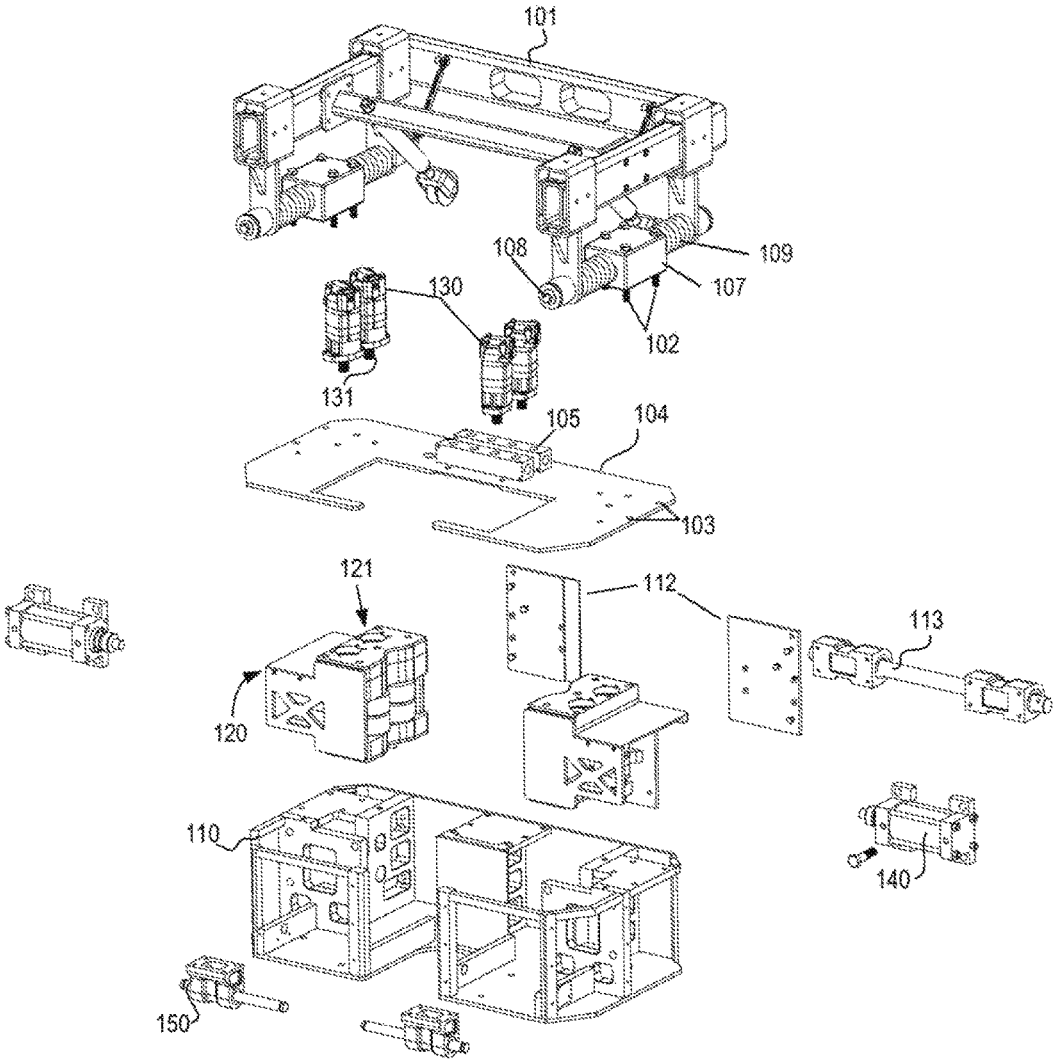
FIG. 10 is an exploded parts view of the spinner module shown in FIG. 9.

FIG. 9 is a perspective view of the spinner module of the system shown in any of FIGS. 5-8 to illustrate constituent components thereof; and FIG. 10 is an exploded parts view of the spinner module shown in FIG. 9. The spinner module 100, like the other components of system 10, is operated from the remote operator console 500 to distance rig personnel from a hazardous area. The spinner module 100 is designed to spin one (upper) of two disconnected pieces of pipe to connect them together at threaded ends (or to disconnect two pipes at its threaded engagement), engaging a vertical drill pipe with up to 3000 ft-lbs of spinner torque.

Referring to FIGS. 9 and 10, the spinner module 100 is completely self-adjusting to varied pipe diameters so as to accommodate pipe diameters between 3½" to 10". This is possible by the opposed roller pairs 127 being able to move laterally inward (within its roller block assembly 120) toward the drill pipe that is provided in an opening (also referred to as the throat) in the spinner module 100 between the opposed roller block assemblies 120, as well as to being able to move laterally outward and away from the drill pipe. Each opposed roller block assembly 120 thus is able to laterally move in and out to engage their corresponding rollers 127 to drill pipes having varied diameters. Additionally, spacing between the adjacent rollers 127 in a pair is provided so as to allow each independent roller 127 free movement to engage the pipe. Moreover, the entire spinner module 100, as it is connected to the suspension frame 101, is configured to rotate, move, or wiggle in any direction in order to facilitate or assist centering the pipe in the opening between the opposed pair sets of rollers 127.

Spinner module 100 also includes roller replacement indicators 129 on rollers 127. In an example, this can be visual indicia that appear on the roller 127 after the roller 127 has been subjected to extended wear. The spinner module 100 is configured to have a max spinner torque of 3,000 ft-lbs and a max clamping force of up to 25,000 lbs., for example. Additionally, paired sets of the hydraulic motors 130 which power the rollers 127 in the roller block assemblies 120 are timed with a timing gear (not shown), so that if a single motor 130 is lost, the spinner module 100 can still achieve torque.

As shown in FIGS. 9 and 10, the spinner module 100 is attached to a pair of spinner module mounting blocks 107 on the suspension frame 101 via bolts 102 which are captured in threaded bores 103 formed in its top cover 104. Removing those four bolts 102 facilitates a quick removal of the spinner module 100 from the suspension frame 101, if parts need to be changed out or an entire replacement module is needed. The top cover 104 includes a manifold 105 which attach to the hydraulic motors 130. Each spinner module mounting block 107 has a rod 108 extending therethrough that is captured at both ends in the suspension frame 101, and a pair of springs 109 along the rod 108, one on either side of the mounting block 107. The springs 109 allow for misalignment and movements caused by bent or mis-centered pipe, as well as shock loads to the spinner module 100 due to torqueing operations. Moreover, and as mounted to the suspension frame 101, the springs 109 allow the spinner module 100 to flex and move in a plurality of directions (left/right, fore/aft), thereby assisting self-centering the spinner module 100 on the drill pipe.

A base weldment 110 is attached to the top cover 104. Base weldment 110 houses a pair of roller block assemblies 120 in facing or opposed relation to one another, with an opening there between (known or referred to as the throat) in the spinner module 100 for receiving a section of vertical pipe there through. Each roller block assembly 120 supports a pair of rollers 127 in adjacent or side-by-side relation that are configured to contact the pipe on either side thereof and spin the pipe. The tandem rollers 127 in each roller block assembly 120 are powered through a pair of hydraulic motors 130, and a clamp cylinder 140 connected at the rear of the roller block assembly 120 provides the motive force to move the roller block assembly 120 with its associated tandem rollers 127 laterally toward or away from the pipe in the opening in the spinner module 100 that is provided between opposed roller block assemblies 120. Each motor 130 has a shaft 131 received in an aperture 121 in a corresponding roller block assembly 120. A back sliding plate 112 meets the rear side of each roller block assembly 120, and a front linear block 150 is situated in front of each roller block assembly 120. The front linear blocks 150 maintain the roller block assemblies 120 aligned with back linear block 113 during clamping operations. A back linear block 113 is attached to the back sliding plates 112. The back linear block 113 is on a rail and serves as a guide to maintain the roller block assemblies 120 with their associated pairs of adjacent rollers 127 square as they laterally move in an out toward or away from the pipe under power of the clamp cylinders 140. The back sliding plates 112 and back linear block 113 are double-sealed by bearings and can operate in harsh environments. The clamp cylinders 140 provide the motive power to move the roller block assemblies 120 laterally toward or away from the drill pipe in the opening between opposed roller block assemblies 120, and to provide the clamp force for the rollers 127.

Figure 11:
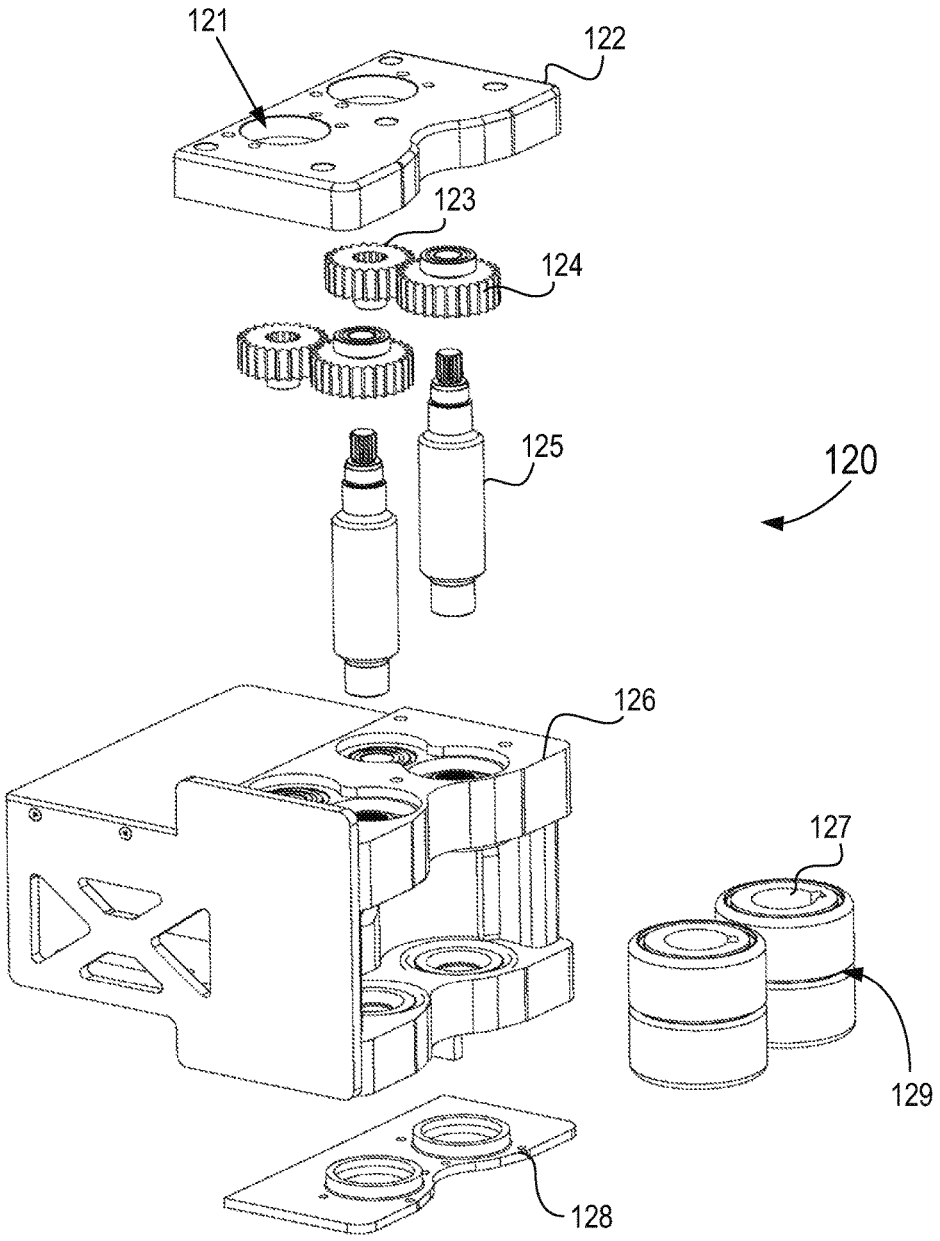
FIG. 11 is an exploded parts view of a roller block assembly in the spinner module of FIG. 9.

FIG. 11 is an exploded parts view of a roller block assembly in the spinner module of FIG. 9. Referring to FIG. 11, the roller block assembly 120 includes a gear cover 122 with apertures 121 for receiving the motor shafts 131 of hydraulic motor 130, the motor shaft turning a drive gear 123 which turns a driven gear 124 attached to a drive shaft 125. The drive shafts 125 sit in and through central vertical bores formed in the rollers 127 within the roller weldment 126 and are configured to rotate the rollers 127, the bottoms of which contact a bearing endshield 128. As the opposed pairs of rollers 127 move inward from both sides (either side of the pipe) due to the push of the clamp cylinders 140 on the roller block assemblies 120 to apply the clamping force on the pipe, they move around the pipe so as to center the pipe directly between the opposed sets of rollers 127. Once the rollers 127 apply the maximum clamping force, the pipe is automatically centered between the opposed pairs of rollers 127. Also as can be seen, there are no zerks or grease points in the roller block assembly 120; the roller block assembly 120 is impervious to salt exposure and employs a double-lipped bearing endshield 128 at its bottom.

The spinner module 100 is designed to be modular and removable; it can be removed as a unit in just a few minutes. This is done by removing eight (8) bolts and five (5) quick disconnects. The new module can be installed in just a few minutes. The roller block assembly 120 can also be removed and replaced in just a few minutes. The roller block assembly 120 is generic so a roller block assembly 120 will fit both the left and right side. It can be replaced by removing four (4) bolts and it will come out as a complete assembly.

Should the spinner module 100 break or otherwise require replacement or servicing offsite, the spinner module 100 can be easily removed by detaching two (2) high pressure quick disconnect lines (source and return) and three (3) low pressure quick disconnect control lines for the safety interlocks. This allows the spinner module 100 to be removed as a unit in one modular assembly. A new spinner module can be installed in a few minutes and the roughneck system 10 is fully functional again. All other conventional roughnecks have to be disassembled and repaired in place on the drill rig floor, requiring substantial drilling downtime.

Figure 12:
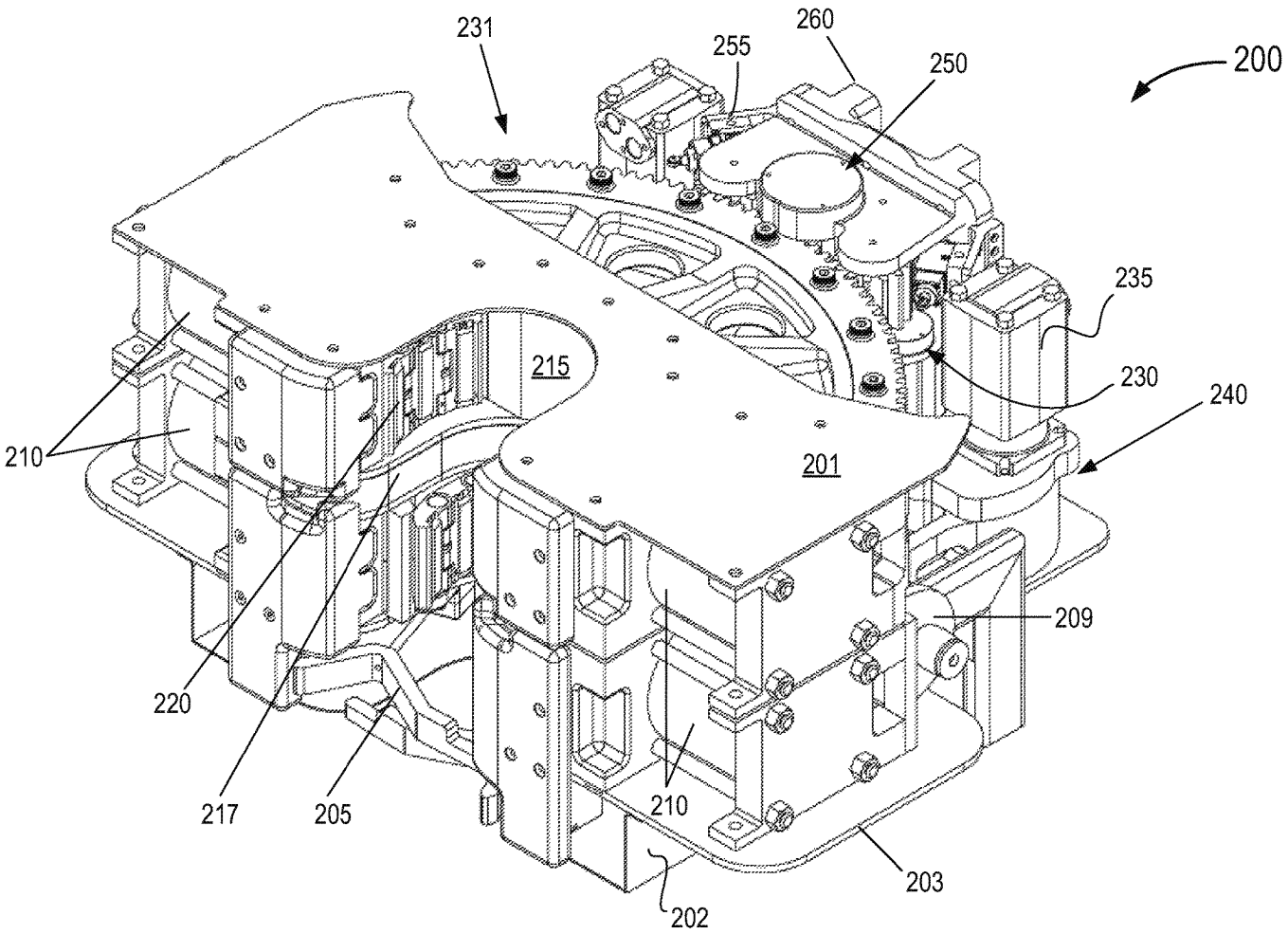
FIG. 12 is a perspective view of the torque module of the system as shown in any of FIGS. 5-8 to illustrate constituent components thereof.
Figure 13:
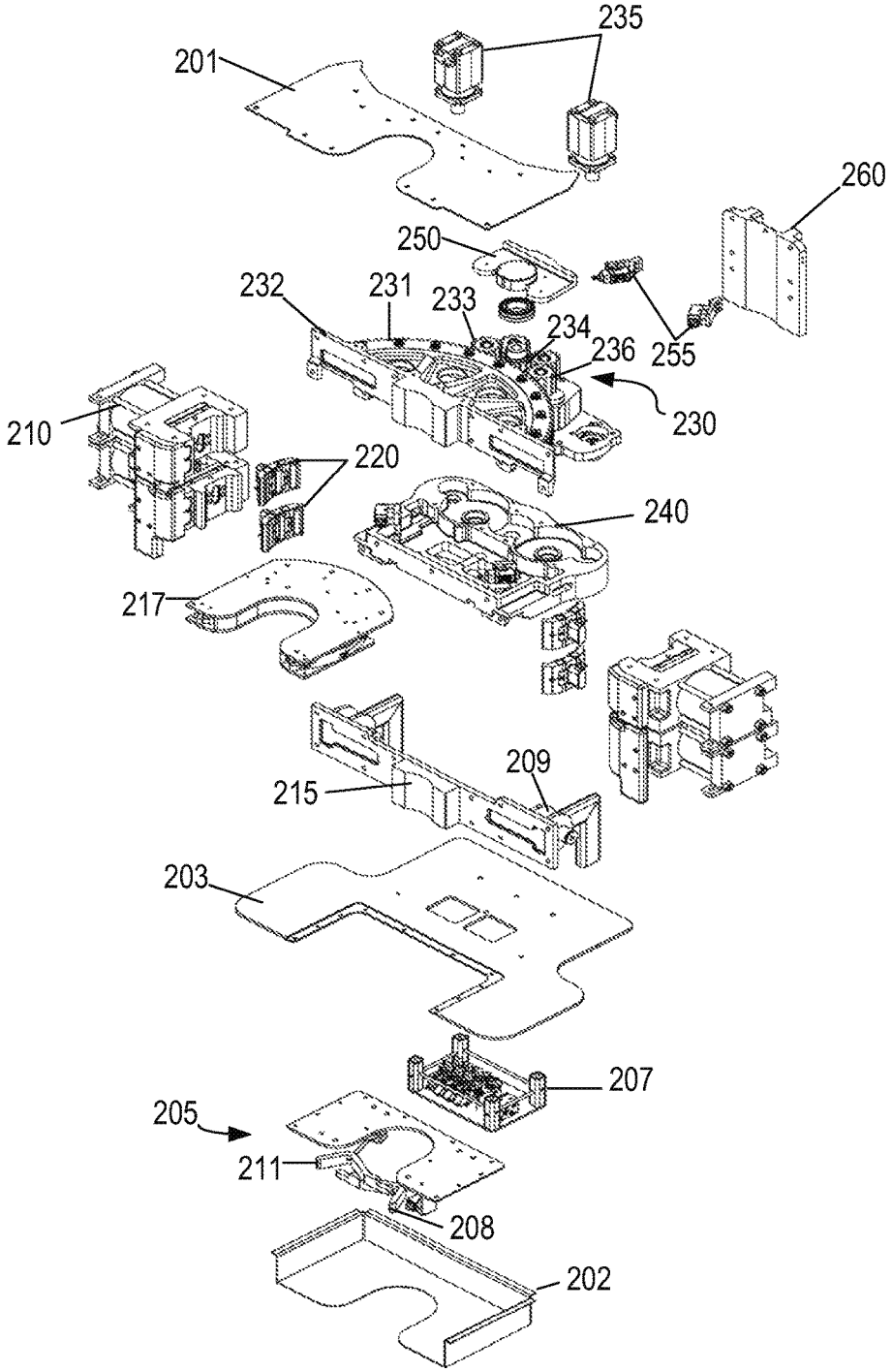
FIG. 13 is an exploded parts view of the torque module shown in FIG. 12.

FIG. 12 is a perspective view of the torque module shown in any of FIGS. 5-8 to illustrate constituent components thereof, and FIG. 13 is an exploded parts view of the torque module shown in FIG. 12. The torque module 200 is designed to torque down on the pipe connections connected by the spinner module 100 to a greater torque, up to 120,000 ft-lbs (max for break-out), with extreme accuracy as to the torque applied, or to otherwise break the connection between two pipes (by torqueing down or holding the lower connected pipe part) together with the spinner module 100 spinning the upper connected pipe in the opposite or counter-clockwise direction to unthread it from the lower drill pipe. This accuracy is due to the torque module 200's use of a gear drive and hydraulic motors and maintaining the force angle at 90 degrees, rather than by using cylinders alone as in the prior art (in which the force angle changes as the torque is applied by the cylinder).

In general, the hydraulic torque module 200 ("torque module 200") employs two high torque motors and a set of six gears to achieve accurate high torque values. The design described hereafter also measures the actual torque at the pipe using a load cell. All other conventional designs use the hydraulic pressure of a cylinder to calculate the torque. The example design improves accuracy because it measures the actual torque, rather than employing a calculated torque, and the torque force is applied to a rotation head at a 90 degree angle so it is always correct (always achieving a 90 degree force angle).

The torque module 200 is used to drive pairs of opposed or facing sets of clamp cylinders 210 toward opposite sides of a pipe that extends through an opening in the torque module 200 between the paired sets of facing clamp cylinders 210, without the limitations of a cylinder torque module. As shown, the torque module 200 includes a six-gear gearbox assembly 230 (see FIG. 13) driven under control of a pair of hydraulic torque motors 235. A transmission through the gearbox assembly 230 actuates the clamp cylinders 210, which apply torque to the pipe grip fingers 220 that are connected to piston rods of the clamp cylinders 210. A detailed illustration and description of how the pipe grip fingers 220 clamp around a drill pipe can be found in my co-pending U.S. patent application Ser. No. 13/868,789 ('789 application), filed Apr. 23, 2013 and entitled "Variable Diameter Pipe Clamp Apparatus and torque Module Therefor", the entire contents of which are hereby incorporated by reference herein.

The torque module 200 includes an upper torque head that is rotatable from a neutral position up to 52 degrees clockwise (CW) or counterclockwise (CCW). A top view showing example rotation of the upper torque head in the torque module is shown in my '789 application. Referring to FIGS. 12 and 13, the upper torque head includes a pair of opposed upper clamp cylinders 210 with attached pipe fingers 220, the top surfaces of the upper clamp cylinders 210 attached to a top cover 201 of the torque module 200, and the rear sides of which attached to a large, semi-circular torque gear 231 (also referred to as a torque gear) of the gearbox assembly 230 via an elongate reaction beam 232. The second pair of lower clamp cylinders 210 in opposed relation to one another and beneath the upper clamp cylinders 210 compose part of a lower torque head, are fixed and do not rotate.

For the upper torque head to rotate about a drill pipe, the teeth of the torque gear 231 engage with teeth of the three driving gears 233, 234, 236 of the gearbox 230 that are positioned directly behind and in engagement with the torque gear 231. A handle on the operator console 500 is actuated to deliver hydraulic pressure to the hydraulic motors 235, which in turn rotates gears in the gearbox assembly 230. This causes the three drive gears 233, 234, 236 to turn the torque gear 231 (torque gear) laterally (either clockwise or counterclockwise up to 52 degrees from neutral, depending on the amount of hydraulic pressure applied) along an arc centered on a drill pipe that is in the throat or opening of the torque module 200. The upper torque head of the torque module 200 thus rotates with the torque gear 231, repositioning its set of opposed upper clamp cylinders 210 around the pipe up to 52 degrees clockwise or counterclockwise from a neutral position. Thus, only one turn is required to reach a required maximum torque to make-up or break-out the drill pipe, thereby increasing drilling efficiency by minimizing drilling operational time.

In general, each set of three pipe grip fingers 220 provide three points of engagement to the drill pipe, applying a uniform load spaced around the drill pipe. Thus, for each two sets of facing or opposed pipe grip fingers 220 (opposed from one another across an opening provided therebetween in the torque module 200 to receive a drill pipe), there is a total of six (6) points of uniform, distributed load around the pipe. As there are two vertical sets of opposed clamp cylinders 210 with associated pipe grip fingers 220 in the torque module 200 shown in FIGS. 12 and 13, provided in opposed facing relation to one another across the opening in the torque module 200 which receives the pipe therethrough, there would actually be 12 points of uniform, distributed load around the pipe. Moreover, the articulating nature of the two outer fingers in each set of pipe grip fingers 220 facilitates the ability to accommodate varied pipe diameters without manual adjustment, and does so all the while applying a distributed uniform load.

In the exploded view of FIG. 13, there is shown the constituent components that makeup the torque module 200. The top cover 201 and a guard cover 202 bound the torque module 200; the guard cover 202 supports the flow control module 207 and an automated pipe centering device 205 thereon beneath a base plate 203. The flow control module 207 is provided to stop the forward movement centering the clamps (clamp cylinders 210 with attached pipe grip fingers 220) on the pipe forward and aft, and an automated centering device 205 functions to center the drill pipe in the openings of both the spinner and torque modules 100, 200 for the operator.

Automatically centering the pipe sets up the clamp cylinders 210 perfectly positioned on the drill pipe, so a maximum clamping force can be applied to the connected pipe grip fingers 220. When the spinner module 100 or torque module 200 are clamped around the pipe, the modules 100, 200 are mounted on or supported by springs 109, 209 that allow the modules 100, 200 to move left and right, maximizing the clamping force and preventing damage to the pipe. The automatic centering device 205 allows the operator to move the spinner and torque modules 100, 200 via the extension module 400 to the drill pipe. The centering device 205 senses the drill pipe of any diameter and moves around the drill pipe until the drill pipe is centered forward and aft in the throat or openings of both the spinner module 100 and torque module 200.

The centering device 205 automatically senses drill pipe of varied diameter and moves around the drill pipe until the spinner module 100 and torque module 200 are centered on the drill pipe correctly, allowing the operator to engage the spinner rollers 127 or torque grip fingers 220, thereby providing maximum gripping force all while the operator is standing across the drill floor out of harm's way. The centering device 205 facilitates grasping of drill pipe with a mechanism that automatically stops the extension of the forward extension arms 404, 406 that move the spinner module 100 and torque module 200 toward the drill pipe. This permits the spinner module 100 and torque module 200 to be automatically centered on the drill pipe at the same time. The centering device 205 accommodates a varied diameter of drill pipe that can be accepted by the system 10 without adjustment. Two elements represent the centering device 205, referred to as a left arm 208 and a right arm 211. The functions of these left and right arms 208, 211 is to engage the pipe as it enters the throat or opening of the spinner module 100 and torque module 200 and determine when the centerline of the pipe is at the centerline of both the spinner module 100 and torque module 200. At that point, the centering device 205 automatically stops movement of the forward extension arms 404, 406 of the extension module 400 which carry the spinner module 100 and torque module 200.

When the clamp cylinders 210 with their attached pipe grip fingers 220 are clamped, the spinner and torque modules 100, 200 are mounted on or supported by springs 109, 209 that allow the modules 100, 200 to move left and right automatically, centering the drill pipe in the rotational center of the throats in the spinner module 100 and torque module 200, corresponding to the center of the drill pipe (fore/aft and left/right). By the time the paired sets of opposed pipe grip fingers 220 extending from their corresponding opposed clamp cylinders 210 are fully clamped on the pipe, the respective three-piece pipe grip fingers 220 are stretched around the drill pipe like a chain, applying a uniform maximum force around the pipe.

As previously noted, conventional iron roughnecks have to be moved manually by the operator to center the drill pipe. This is a visual operation and sometimes it is not accomplished correctly. This can cause damage to the roughneck or put the operator at risk. The example system 10 is fully automated on the centering operation and accomplished correctly every time. There is no risk to the operator or the system 10.

A cylinder support frame 215 supports the rear of the lower set of clamp cylinders 210, which make up the lower torque head of the torque module 200. A pair of plastic springs 209 is provided at the ends of the cylinder support frame 215. These springs 209 permit the cylinder support frame 215 with cylinders 210 thereon, and connected parts of torque module 200 attached thereto, to move laterally left and right during clamping operations, so as to assist in automatically centering the torque module 200 on the drill pipe. A rotary assembly cam follower system 217 is used to maintain centers. This cam follower system 217 is used due to the fact that it is an open bearing system; a normal bearing would not work in this application. The cam follower open bearing system 217 is inserted between the two vertically arranged sets of upper and lower clamp cylinders 210 with attached pipe grip fingers 220. Its function is to provide rotation and maintain the upper torque head's center of rotation when the pipe grip fingers 220 are not clamped to the drill pipe. The drill pipe will maintain the center of rotation during torqueing operations. It also allows the upper torque head of the torque module 200 to move up or down as required during the torque process. Part of the gearbox assembly 230 sits in lower gear housing 240. Each hydraulic motor 235 is affixed on either side of the gearbox assembly 230, with a bearing plate 250 on top and a rotating limit assembly 255 on either side of the bearing plate 250. Each rotating limit assembly 255 is designed to stop the upper torque head from rotating over 52 degrees CW or CCW. A back support 260 backs the gearbox assembly 230 and bearing plate 250.

Accordingly, the torque module 200 uses a hydraulic motor design to apply torque, and unlike the conventional cylinder design, which suffers from a cam over effect of the linkage, and is not limited to a single direction rotation and an angular limitation from 0 of 37 degrees. In this case, it may be more realistic to look at the torque motor as a rotary cylinder. The motor 235 rotates and maintains a force application point 90 degrees to the torque center, and each internal section of the motor acts as a cylinder applying the force as it rotates. The upper torque head of the torque module 200, because of its torque motor design, can rotate up to 52 degrees CW or CCW from a neutral position. This allows the operator to make up the drill pipe or breakout the drill pipe from a neutral position in a single evolution, saving a significant amount of time.

The operation of applying the torque 90 degrees to the torque rotator gear (torque gear 231) in gearbox assembly 230 gives the operator a true torque value. It is true torque because the force is applied 90 degrees to the rotator or torque arm which is at the interface between the larger semi-circular torque gear 231 (torque rotator gear) of gearbox 230 that is attached to the upper clamp cylinders 210, and the three drive gears 233, 234, 236 directly behind the torque gear 231 whose teeth mate with the teeth of the torque gear 231 at the top of the gearbox assembly 230 in FIGS. 12 and 13. As the gears rotate, the interface point between the gear teeth is always 90 degrees, so the applied force is a true torque.

All other conventional roughnecks of today use cylinders. As the cylinder extends, it pushes on the torque arm applying the force. As the torque arm rotates, the force angle changes and is no longer 90 degrees. The force decreases by the sin of the force or cylinder rod to the torque arm. So the cylinder does not apply the correct torque. The gears that are applying the force don't move; the torque arm rotates but the force interface point stays constant.

By using hydraulic motors 235, the force is always applied 90 degrees to the force arm or rotator gear. So the torque module 200 puts out a true torque value. The conventional iron roughnecks cannot compensate for the force angle mismatch because the operator never knows how many degrees of rotation they will need to apply. Thus, the force cannot be adjusted to make up for the less than 90 degree angle. Moreover, the torque applied to the clamp cylinder 210 with attached pipe grip fingers 220 can be accomplished in a single motion; it will not take two or more setups, increasing the process speed. This allows for a much smaller design with more torque. Therefore, the use of tandem hydraulic motors 235 to drive a gearbox 230 will provide 150,000 ft-lbs of torque. From start at a 0 or neutral position, the opposed upper clamp cylinders 210 with attached pipe grip fingers 220 in the upper torque head can be rotated CW or CCW up to 52 degrees, to either torque or un-torque drill pipe.

Accordingly, unlike the conventional torque module with cylinder design and its 37 degree of single direction rotation limitation, the torque module 200 employs a torque motor design that can rotate the upper torque head up to 52 degrees CW or CCW from a neutral position. This allows the operator to make up the drill pipe or breakout the drill pipe from a neutral position. This saves time. Additionally, by rotating 52 degrees, the process can be limited to a single operation, avoiding the conventional two step (or more) process for breakout necessitated by the cylinder design. Further, by achieving a uniform clamping area combined with not having to change pipe handling devices to account for a change in pipe diameter, and having the ability to torque 52 degrees CW or CCW, results in a substantial reduction in connection time for the operator time while minimizing pipe damage.

For repair the torque module 200 can be removed as an assembly. To remove the torque module 200 from roughneck system 10, the operator is required to pull two (2) pins, two (2) high pressure quick disconnects, and four (4) control lines. This operation will take just a few minutes and a new torque module 200 can be installed. Conventional iron roughnecks require the operator to rebuild the torque module in place on the rig floor.

The iron roughneck system, inclusive of the torque module 200, utilizes sealed bearings and double o-ring seals to keep caustic or damaging fluids and materials out of all moving parts while maintaining lubricating fluids in place. This serves two purposes: it means that system 10 requires no maintenance, and that the Mean Time Between Failures (MTBF) can be calculated and is very high as compared to non sealed systems. By using high quality materials with yields that drive the safety factors to two (2) or above, roughneck system 10 will last longer, require no maintenance and have very little down time. By making system 10 modular, if it does break it can be repaired quickly, which also minimizes down time.

Figure 14:
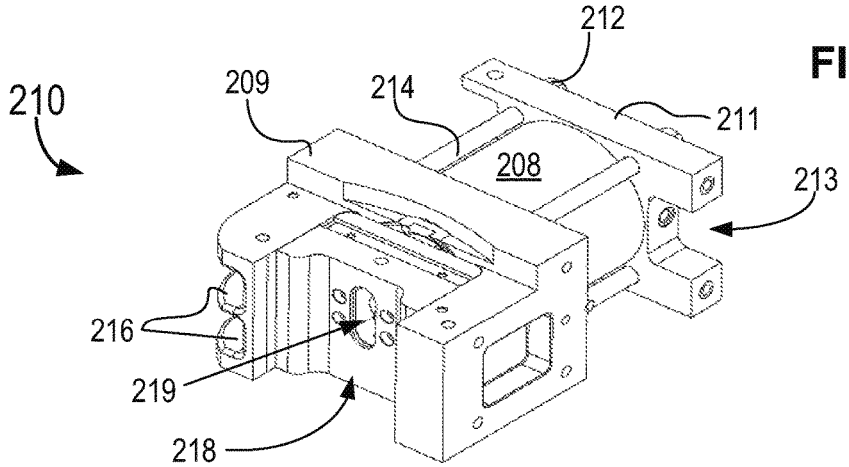
FIG. 14 is a perspective view of a clamp cylinder in the torque module of FIG. 12.
Figure 15:
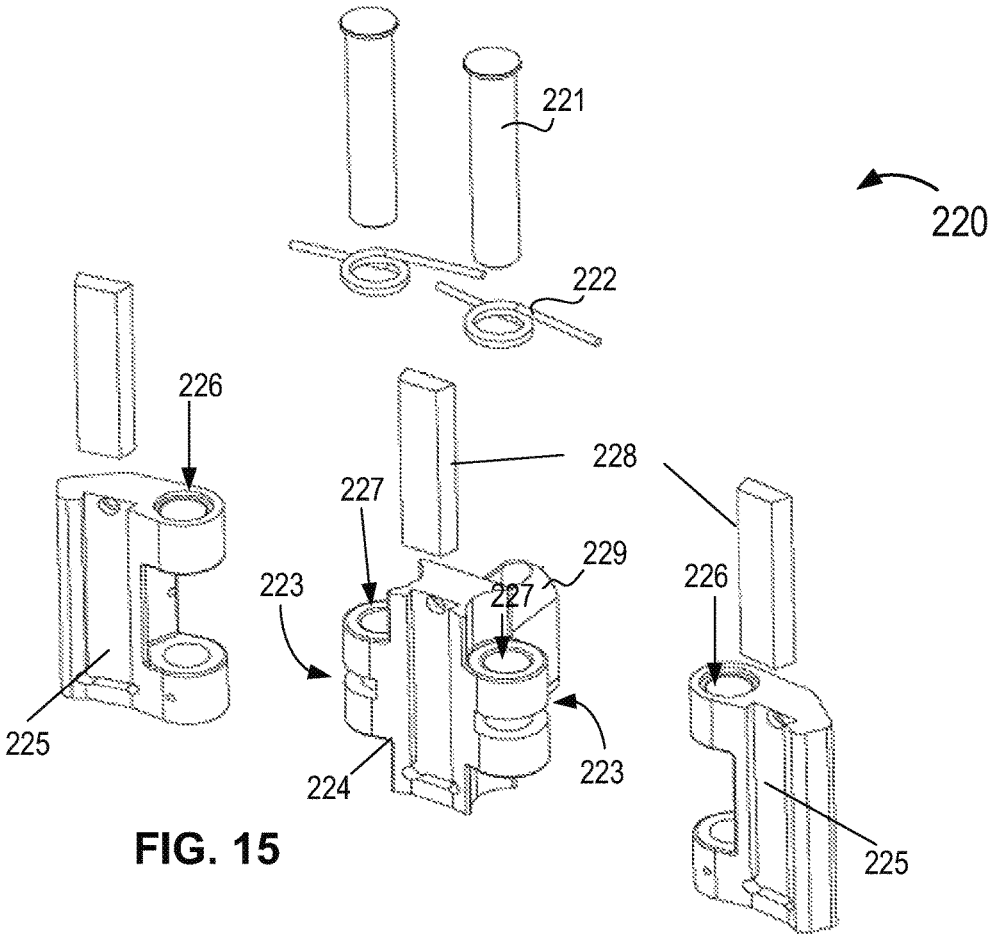
FIG. 15 is a partial exploded parts view of the pipe grip fingers in the torque module shown in FIG. 12.

FIG. 14 is a perspective view of a clamp cylinder in the torque module of FIG. 12. The clamp cylinder 210 receives the torque via the gearbox assembly 230 and applies the torque to the pipe grip fingers 220. FIG. 14 shows the clamp cylinder 210 without the pipe grip fingers 220 thereon. FIG. 15 is a partial exploded parts view of the pipe grip fingers 220 in the torque module 200 shown in FIG. 12.

Referring to FIGS. 14 and 15, the clamp cylinder 210 is comprised of a front block 209 that is separated from a spaced rear plate 211 via a piston cylinder 208. The rear plate 211 has notched recesses 213 therein and the piston cylinder 208 is bounded by bolts 214 attaching front block 209 to rear plate 211 via fasteners 212 such as nuts. One outer side of front block 209 has a set of grooved recesses 216 formed therein, with a central region 218 machined out to receive the dimensions of the pipe grip fingers 220, and a central aperture 219 formed therein by machining to receive a piston part 229 attached at the rear of a center tong grip 224 of the pipe grip fingers 220; center tong grip 224 represents the central finger of the pipe grip fingers 220.

The clamp cylinder 210 serves as the pusher for the pipe grip fingers 220. In order to actuate the clamp cylinders 210, a handle on the operator console 500 is moved to a clamp position. This provides hydraulic fluid to a back side of the piston of piston cylinder 208, which in turn imparts a piston action to the front block 209 which holds the pipe grip fingers 220. Specifically, the front block 209 with central region 218 and aperture 219 acts as a pusher element by way of the piston action imparted to it by piston cylinder 208, moving the front block 209 laterally in and out so as to move the pipe grip fingers 220, (which are attached to the front block 209 via a piston part 229 extending rearward from the center tong grip 224 that is captured in aperture 219 of the front block 209) forward or inward so as to engage the pipe grip fingers 220 around a drill pipe that extends vertically in an opening or throat of the torque module 200 provided between opposed clamp cylinders 210.

In general, the pipe grip fingers 220 are pushed around the drill pipe by the push bar (front block 209). The angle of the push bar to the back of the outside fingers is critical. As it moves forward under the piston action imparted to it by piston cylinder 208, it is designed to push the two outer fingers around the pipe and then stretch the fingers like a chain around the pipe so as to provide a uniform, distributed load around the pipe; this gives the clamp dies (each of the fingers 220 include a metal die insert on its facing serving as a clamp die to contact the pipe wall surface; the clamp die provides a roughened surface for gripping a portion of the pipe) maximum grip and applies minimum stress at a hinge joint between adjacent dies. The fingers 220 also give the operator the perfect interface between the drill pipe and the clamp dies (die inserts) on the fingers 220. The pipe grip fingers 220 operate by having springs (finger springs 222) between the outside fingers (i.e., left/right tong grips 225 in FIG. 15) and the center clamp body (i.e., center tong grip 224 in FIG. 15). The springs 222 keep the fingers 220 in the fully open position when the clamp assembly (fingers 220 with front block 209 of clamp cylinder 210) is retracted. As the clamp assembly (front block 209 with pipe grip fingers 220) moves laterally inward to engage a side of a vertical drill pipe within the opening or throat of the torque module 200, the center clamp body or central finger of the grip pipe fingers 220 hits the pipe first. The center clamp body has a back body spring (not shown) behind it keeping it extended in reaction to the push bar (front block 209). As the center body (center finger) is pushed in from behind, compressing the back body spring, the outside two fingers of pipe grip fingers 220 (outside left and right tongs 225 with their die inserts on facings thereof) pivot or articulate so as to be stretched around the pipe due to the piston action of the push bar (front block 209) and an interface profile between the push bar and the back of the outside fingers, just like hands gripping a pipe. By the time the cylinder 208 is fully clamped, the three-piece pipe grip fingers 220 are stretched around the pipe like a chain applying a uniform maximum force around the pipe that is designed to give the operator maximum holding force during torque and spinning operations.

The two outer fingers of the three-finger pipe grip fingers 220 are thus each configured to be articulated or pivotal about a pin connecting them to the central finger, so as to be movable around the pipe, with the central member or central finger designed to initially contact the pipe side wall first, head on and flush. This is why the pipe fingers 220 are able to accommodate different pipe diameters without any adjustment. Each finger of the pipe grip fingers 220 is further composed as a tong grip designed to hold a metal die insert therein. Referring to FIG. 15, each of the left tong grip 225, center tong grip 224, and right tong grip 225 have recessed slots in their facing which hold die inserts 228 therein, the die insert also referred to as a clamp die, with the die insert 228 having a roughened surface on its facing to improve gripping of the pipe. Pins 221 fit through aligned holes 226, 227 to connect the two outer tong grips 225 to the center tong grip 224 of the pipe grip fingers 220. Each one of a pair of finger springs 222 is inserted on either side of center tong 224 between the holes at 223 around a pin 221 to provide tensional force, so as to maintain the left and right tong grips 225 of pipe grip fingers 220 biased in an open or neutral position when not under the tension of a pipe.

A back body spring (not shown) maintains a half-inch clearance between the pusher (front block 209) and the center tong grip 224, and rides on a pin (not shown). Finger springs 222 may be set to 100 ft-lbf, and back body spring may be set to 400 ft-lbf. Accordingly, the springs 222 enable to pipe grip fingers 220 to always remain in the open position when not under tension by a pipe. The finger springs 222 maintain the fingers' left and right tong grips 225 in an open position, until the front block 209 of the clamp cylinder 210 moves forward under the piston action imparted by cylinder 208 and closes them. The back body spring keeps the center tong grip 224 moved forward maintaining a gap between the center tong grip 224 and front block 209.

Referring occasionally also to FIGS. 12 and 13, an example closer sequence of operation for the pipe grip fingers 220 in torque module 200 is as follows, with the assumption that a drill pipe is vertically extended through the opening in the torque module between the opposed clamp cylinders 210: (a) the left and right tongs 225 will move toward the pipe by way of the front block 209 on each clamp cylinder 210—each of the front blocks 209 moving a corresponding one of the four sets of pipe grip fingers 220 inward toward the pipe in tandem in this particular example (there could be fewer or more sets of pipe grip fingers 220 used); (b) each center tong grip 224 will hit the pipe first, then stop; (c) each front block 209 ("pusher") of a clamp cylinder 210 will continue to move forward.

The pusher moving forward will (d) cause each of the left/right tong grips 225 to stretch, articulate, pivot, and/or pull around the drill pipe due to the unique angle on the back of the left/right tong grips 225 and how the force from the pusher is applied. This unique pulling process will cause a uniform gripping load around the pipe that is diameter independent; in other words this signifies that the pipe grip fingers 220 can accommodate varied pipe diameters. When (e) the pipe grip fingers 220 are released from the drill pipe, the left/right tong grips 225, center tong grip 224 and pusher (front block 209 of each clamp cylinder 210, under piston cylinder 208 control) will return to their fully open positions under spring 222/back spring pressure, and the process can be repeated.

Accordingly, the pipe grip fingers 220 are configured so as to automatically adjust to a varied range of pipe diameters, unlike existing pipe clamps which must utilize inserts and/or change out the dies in order to account for changing pipe diameters. In one example, the pipe grip fingers 220 may automatically adjust to pipe having a diameter in a range of about 4" to 10", to be torqued up to about 150,000 ft-lb via the example torque module 200. Accordingly, the example pipe grip fingers 220 offers a variable radius clamp design to enable an operator to change pipe diameters without changing clamp dies, while still maintaining a uniform clamping area and clamping pressure around the pipe.

The clamp cylinders 210 are held in place by six (6) bolts and can be removed as a complete assembly. The pipe grip fingers 220 can be removed as a complete assembly by pulling the two (2) pins 221. This removal requires two special tools, a finger spring compressor and a pin extractor. To remove the fingers 220, place the finger spring compressor between the finger clamps and extend, this will compress the spring 222 located behind the clamp finger assembly. After compressing the finger spring 222, insert the pin extractor and remove the upper and lower pin 221; then remove the finger spring compressor and remove the pipe grip fingers 220. The pipe grip fingers 220 can thus be repaired or replaced as an assembly.

Figure 16:
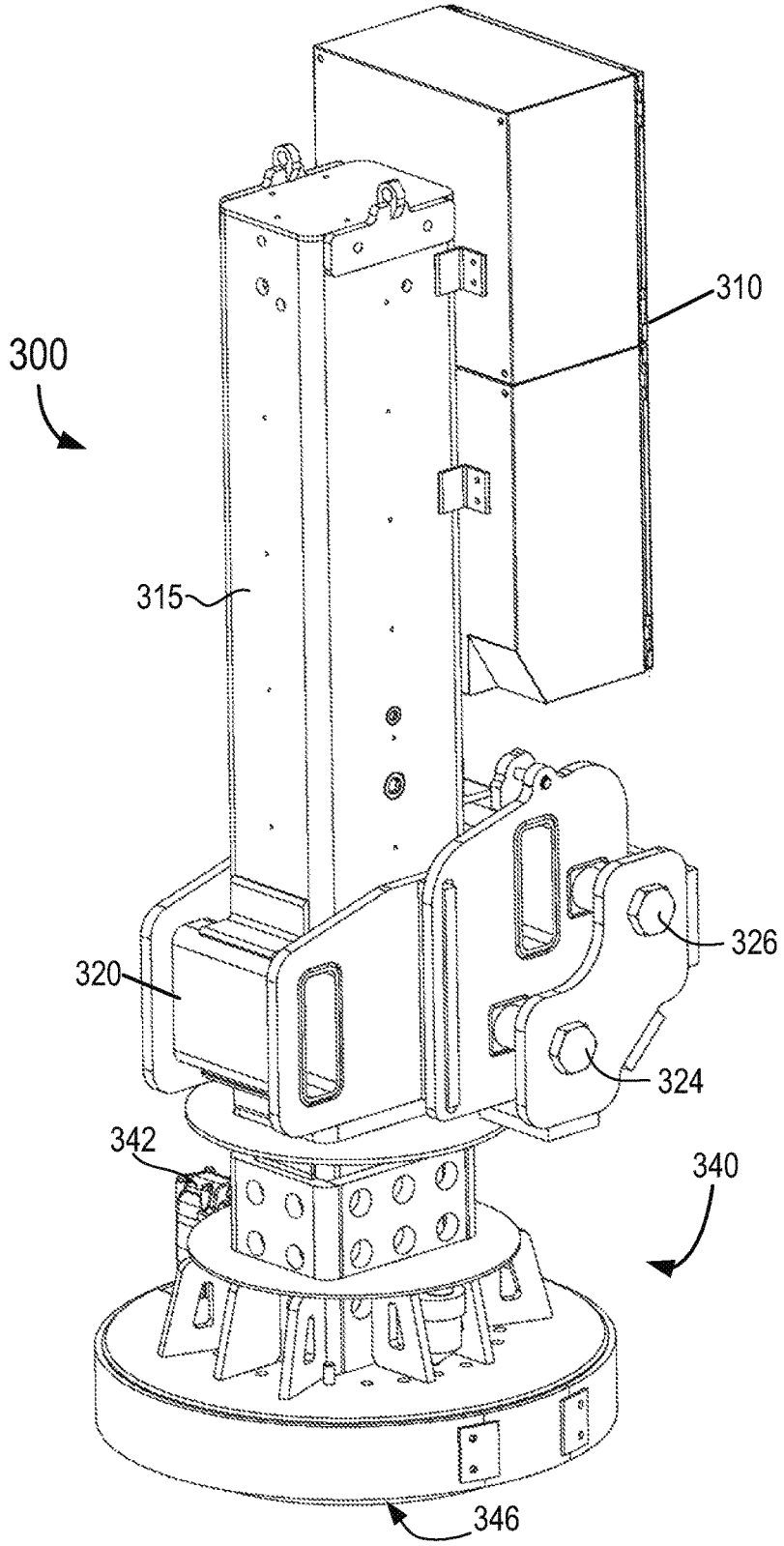
FIG. 16 is a perspective view of the base module of the system as shown in any of FIGS. 5-8 to illustrate constituent components thereof.
Figure 17:
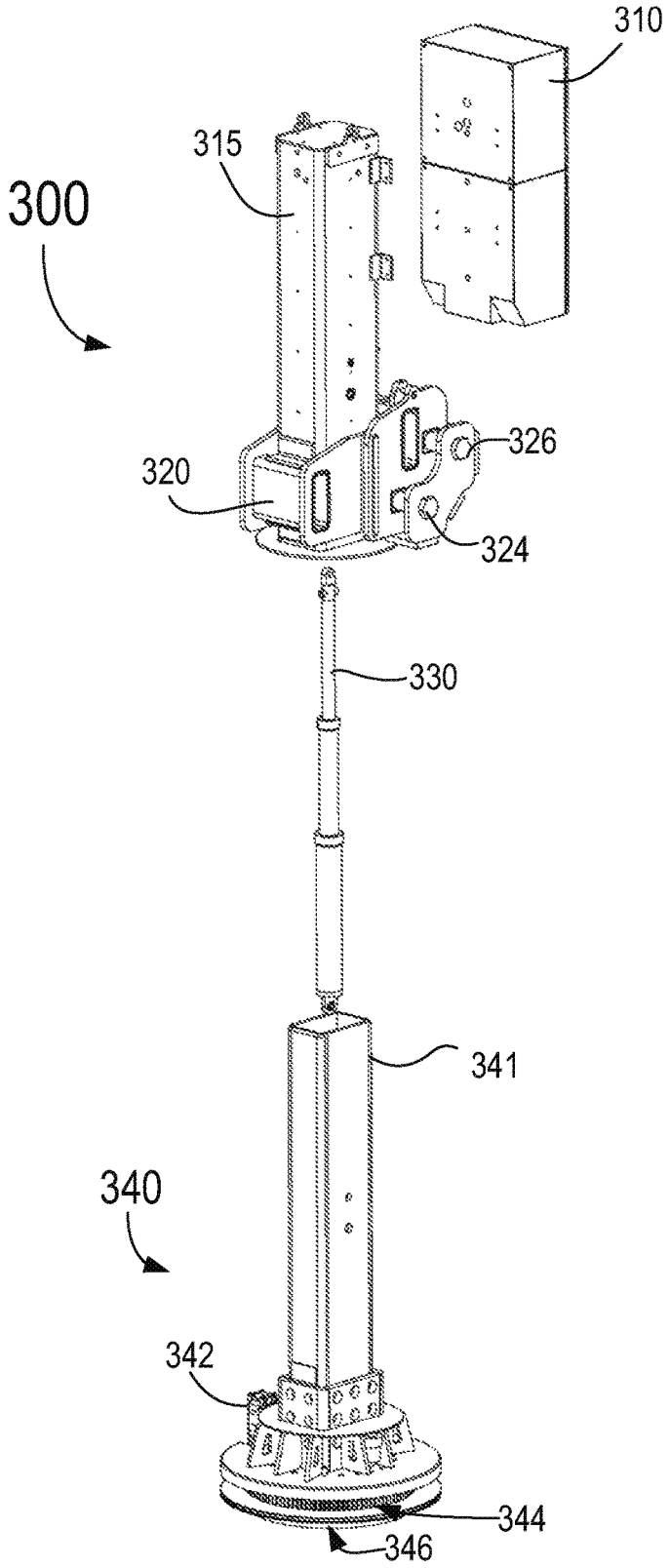
FIG. 17 is a partial exploded parts view of the base module of FIG. 16 to show selected components thereof.
Figure 18:
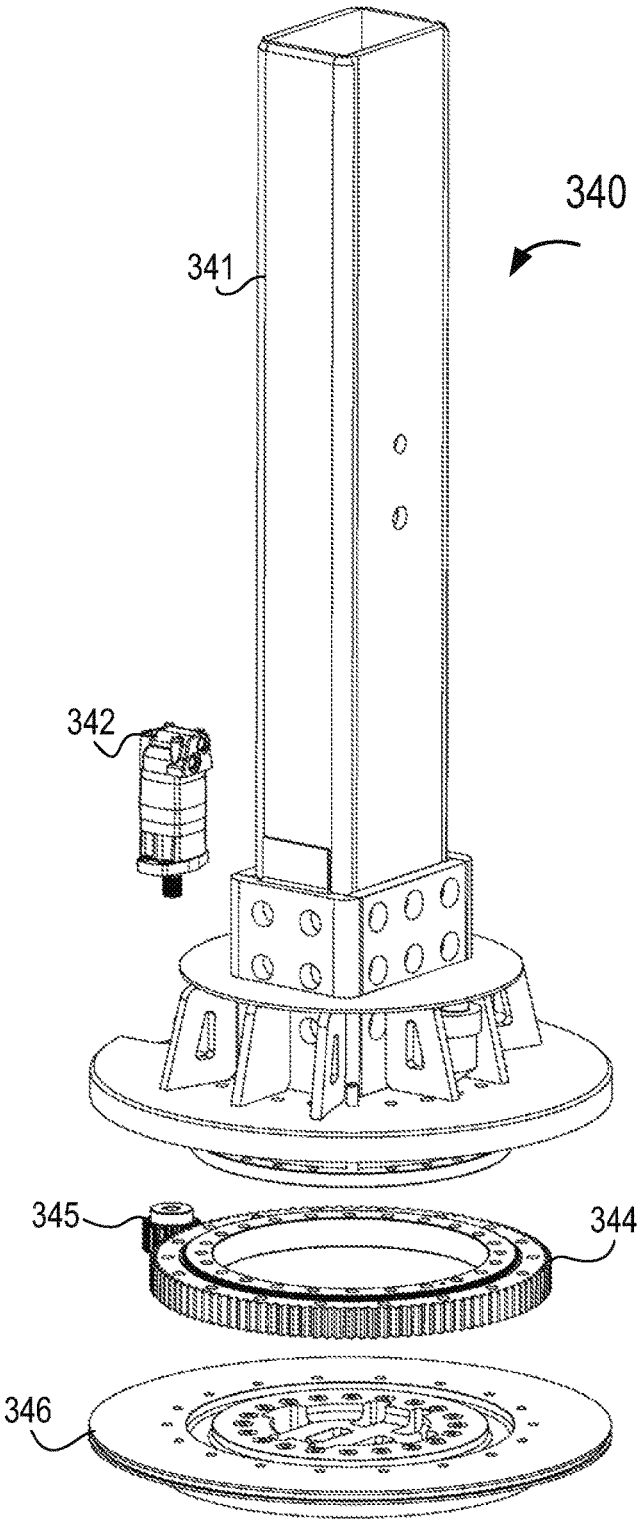
FIG. 18 is an exploded parts view of the base column assembly shown in FIG. 17 to show details thereof.

FIG. 16 is a perspective view of the base module of the system as shown in any of FIGS. 5-8 to illustrate constituent components thereof; FIG. 17 is a partial exploded parts view of the base module of FIG. 16 to show selected components thereof; and FIG. 18 is an exploded parts view of the base column assembly shown in FIG. 17 to show details thereof. Referring to FIGS. 16-18, the base module 300 comprises a control box 310, a vertical displacement cage 315 with a bushing 320 at its lower end, a 2-stage coarse lifting cylinder 330, and a base column assembly 340. The base column assembly 340 is situated within the vertical displacement cage 315, and in turn encloses the lifting cylinder 330.

In conjunction with the extension module 400 to be discussed hereafter, the base module 300 provides for a flat trajectory when repositioning the spinner module 100 and torque module 200, via the extension module 400, up to a 10 foot horizontal range from its location (i.e., no height change to the well operation point) so as to speed time to commence drilling operations. The base module 300 is configured to provide a powered left/right rotation, and powered height adjustment with both coarse and fine height adjustments. Coarse height adjustment allows for +/−18" from a 41" centerline, or a total of 36" of coarse vertical height adjustment. Further, coarse adjustment may be preset before operations, so that only fine vertical height adjustment need be made before commencing make-up and break-out operations. Fine vertical height adjustment allows for +/−6" of vertical adjustment, due to tool joint placement. There is also a mouse hole tilt adjustment for mouse hole operations that allows for +/−10 degrees.

The lifting cylinder 330 is designed, under hydraulic control (the controls are in the operator console 500 but they run through the control box 310 and safety interlock system) to raise and lower the vertical displacement cage 315 with control box 310 attached thereto, which rides up or down along a center column 341 of a base column assembly 340, so as to provide coarse vertical height adjustment for the base module 300. The vertical displacement cage 315 rides on the base column assembly 340. The bushing 320 includes connecting pins 324, 326 of an arm connector unit. These connecting pins 324, 326 secure the lower ends of the rearward extensions arms 404, 406 extending from the central hub 401 of the extension module 400 to the bushing 320.

As shown in FIG. 18, the base column assembly 340 includes a center column 341, a hydraulic rotary motor 342, a slew bearing 344 with pinion 345, and an adapter plate 346. The center column 341 receives the lifting cylinder 330 therein which vertically moves the vertical displacement cage 315 vertically up and down along the outer surface of the center column 341. The rotary motor 342 permits left and right rotational movement of the base module 300 on the slew bearing 342 with pinion 345. The adapter plate 346 conforms to the size of a standard ST-80C adapter plate so that system 10 can be retrofitted in place at any well or rig site currently using an ST-80 roughneck. The base module 300 employs double o-rings throughout and automatic greasers to eliminate maintenance and downtime, while providing a base module 300 that is impervious to saltwater exposure.

The system 10 has both a coarse and fine vertical adjustment system. This works to the operator's advantage and will save the operator time because the extension module 400 provides level horizontal movement during the extension process with no change in the height along the length of extension. The flat horizontal extension allows the operator to preset a normal operating height with the coarse adjustment at the base module 300 before commencing operations. This is based on the driller; the driller will stop or set the tool joint at a normal height within a few inches. This will then allow the operator to just use the fine vertical adjustment. It will provide him more control and make the movements faster.

The coarse vertical height adjustment moves the entire system up and down back at the base module 300, and is very jerky to adjust due to the weight and size of the system. This jerky movement is magnified the more the unit is extended. The fine vertical height adjustment is located on the torque head and only moves the torque head (e.g., at the torque module 200, held by an A-frame 430 and torque module frame 434) up and down. This provides a much finer and smooth movement. Being able to preset the coarse height adjustment and only having to manipulate the fine height adjustment of the extension module 400 will save the operator time.

Figure 19:
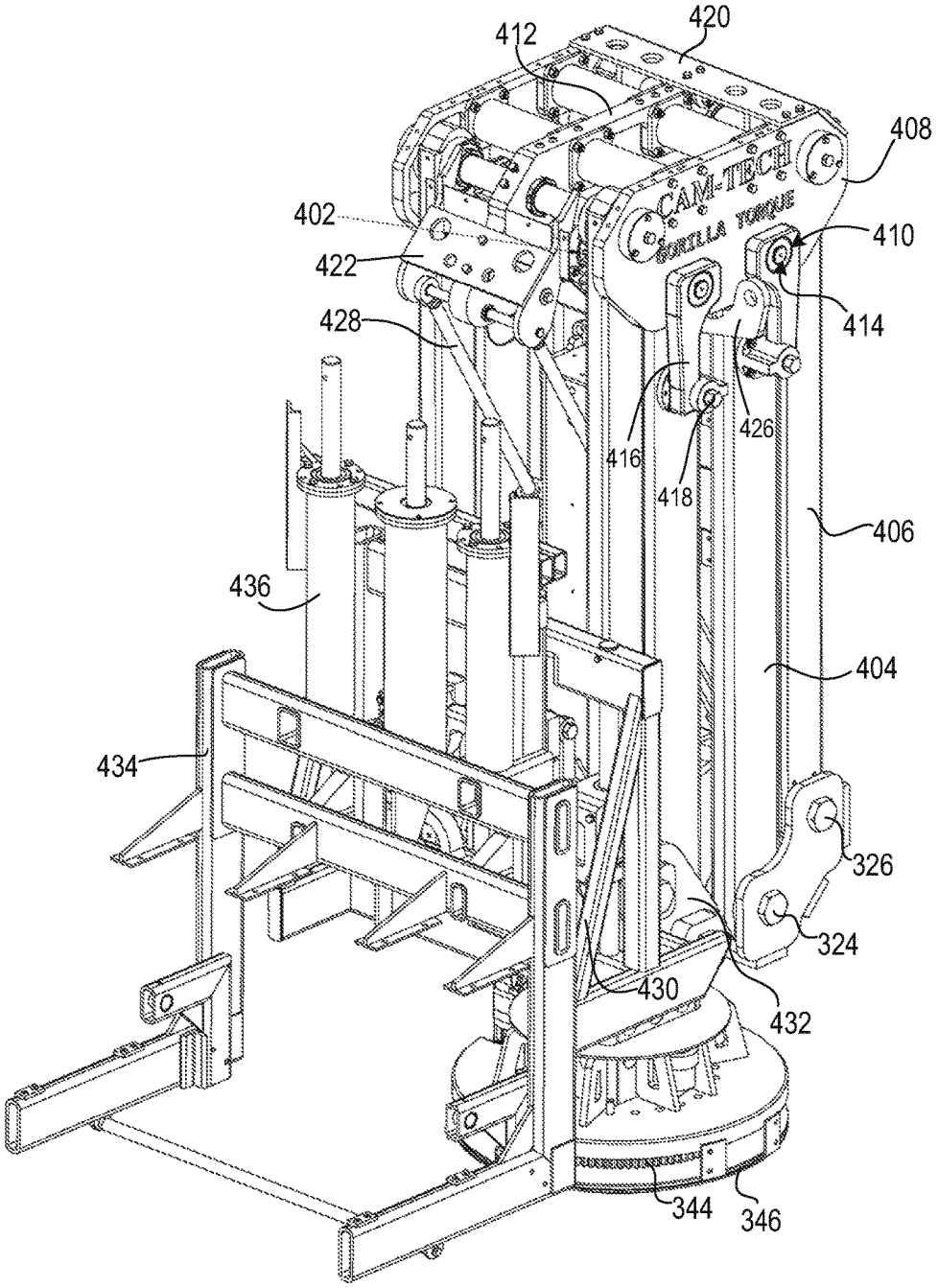
FIG. 19 is a perspective view of the extension module of the system as shown in any of FIGS. 5-8 to illustrate constituent components thereof.
Figure 20:
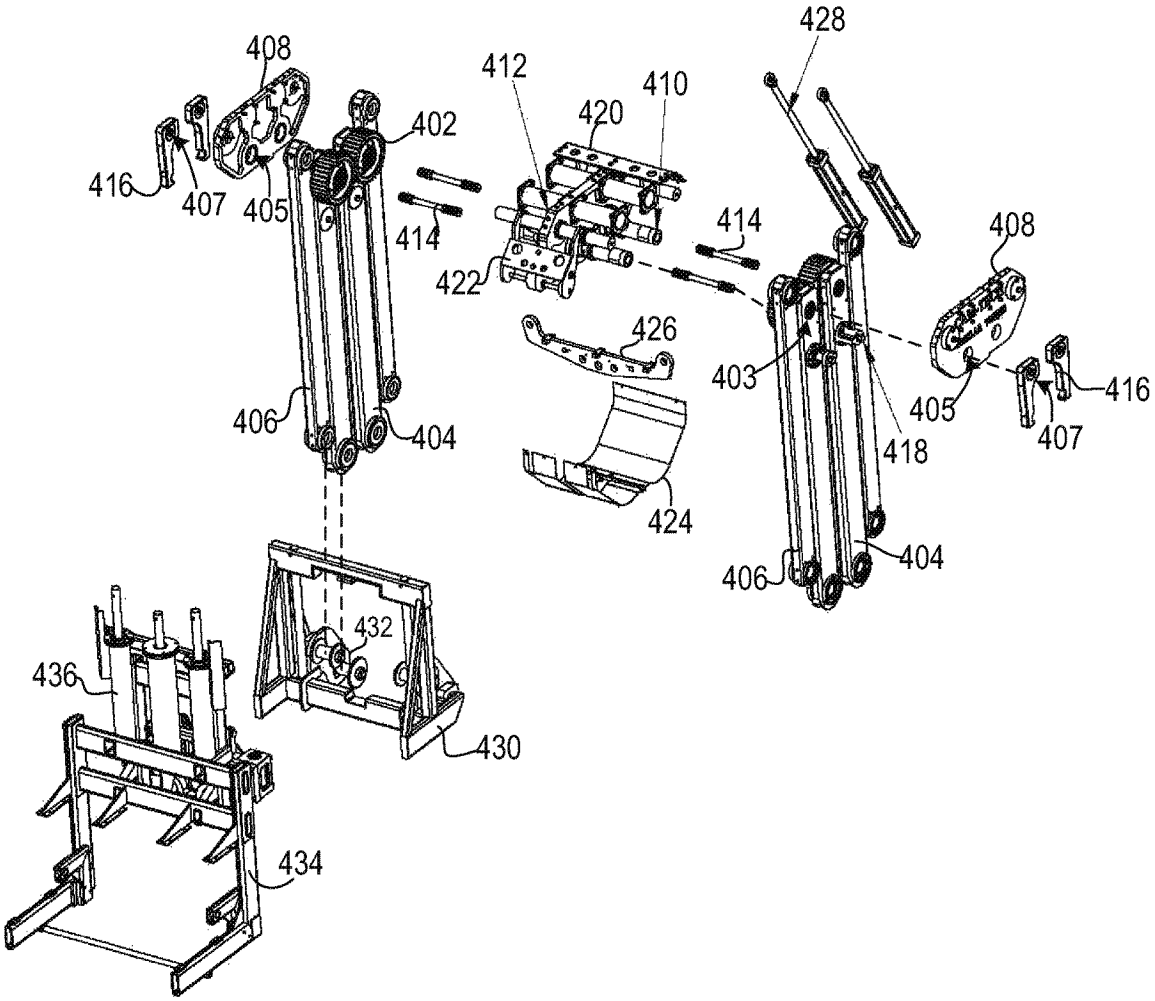
FIG. 20 is an exploded parts view of the extension module shown in FIG. 19.

FIG. 19 is a perspective view of the extension module of the system as shown in any of FIGS. 5-8 to illustrate constituent components thereof; and FIG. 20 is an exploded parts view of the extension module shown in FIG. 19. Referring to FIGS. 19 and 20, the extension module 400 in FIG. 19 is shown connected to base module 300 with the spinner module 100 and torque module 200 removed. Occasional reference should be made to FIG. 6 as well for the following discussion. The extension module 400 allows up to 10 feet of travel horizontally for the spinner and torque modules 100, 200 with no change in height, i.e., a flat trajectory over the range of travel. The extension module 400 employs two sets of paired timing gears 402. Because of the timing gears 402, the A-frame 430 and torque module frame 434 that is connected to the A-frame 430 remain perpendicular to and parallel to the ground at all times. The timing gears 402 ensure that the forward extension arms (inner 404 and outer 406) connected to the A-frame 430, and the rearward extension arms 404, 406 connected to the base module 300 (at pins 324, 326) each stay at the same angle or arc of travel throughout their range of extension. Thus, to increase or decrease the extension range, one only needs to change the length of the extension arms 404, 406, and nothing else. This allows the extension arms 404, 406 to move in and out in a "true piston" fashion; there is no vertical movement whatsoever.

The timing gears 402 are coupled to the top ends of the inner extension arms 404 and the inner arms 404 and outer extension arms 406 are secured to the inside of side plates 408. The extension module 400 includes a center plate 412 that divides the two sides into compartments having a mirror relation. A set of torsion rods 414 perpendicular to and on either side of the center plate 412 is employed, captured through hollow shafts 410, each torsion rod 414 within its hollow shaft 410 extending through a timing gear 402, an aperture 403 in inner extension arm 404, through an aperture 405 in side plate 408, and then into an aperture 407 that terminates within a lever arm 416 that is secured on the outside of each inner extension arm 404. This connective arrangement is shown generally by a generally horizontal dotted line in the upper half of FIG. 20. Each torsion rod 414 is designed to cooperate with its corresponding lever arm 416 to impart a retraction force that counters the extension forces generated by the extension module 400 as the forward and rearward sets of extension arms 404, 406 extend under a weighted load. This will be described in more detail hereafter. The torsion rod 414 can be preloaded via an eccentric shaft 418.

The central hub 401 of the extension module 400 includes an end plate 420, a lower cover 424 and a center brace 426 for stability. There is also provided an interface plate 422 and a pair of extension cylinders 428 connected thereto, a primary extension cylinder and a dummy backup. Each extension cylinder 428 includes a rod element connected to the interface plate 422 located on a front side of central hub 401 and a piston cylinder element connected to the rearward outer extension arm 406 end; see the connections for example in FIG. 6. The purpose of the extension cylinder 428 is to provide an extension force. This is required due to the fact that the torsion rods 414 maintain a closer force of up to 400 lbs. during the full extension range, so the extension cylinders 428 also provide resistance to this closing force. The cylinders 428 will hold the extension module 400 in an extended position or control the movement during closing. The cylinders 428 will move or control the movement of the extension module 400 while the timing gears 402 will maintain the forward/rearward extension arms 404, 406 angular position to each other the same through the range of extension in the extension module 400.

The use of timing gears 402 and a single extension cylinder 428 are significant. The timing gears 402 enable the extension module 400 to maintain a flat trajectory along the horizontal plane upon extension and retraction of the forward and rearward extension arms 404, 406 from/to the central hub 401, so as to mimic the movement of a true piston (e.g., the movement of an item in and out without it moving up or down, left or right as it moves in and out) with only one extension cylinder. Conventional roughnecks employ two extension cylinders, one on the back set of extension arms, and one cylinder on the front set of arms (extends the arms but move out and up at a different rate then the back arms so they have to be adjusted separately). Operators then have to adjust the cylinders individually to get the extension unit where they want it vertically.

By employing the timing gears 402 in central hub 401, as the rear extension arms 404, 406 extend they arc over; the timing gears 402 extend the front extension arms 404, 406 at the same rate as the rear extension arms 404, 406 and the front extension arms 404, 406 arc up at the same rate the rear extension arms 404, 406 arc over. By doing this, the vertical height of the extension module 400 is maintained constant with only a single extension cylinder 428. The paired sets of rear extension arms 404, 406 and the paired sets of forward extension arms 404, 406 of the extension module 400 thus move in and out together as a true piston. This saves the operator time; he only has to set the vertical height once and can piston in and out after each tool joint is moved into place. The extension module 400 only has two extension cylinders 428 for redundancy; the second extension cylinder 428 is a back up to the first for a double safety factor. Either extension cylinder 428 can operate without the other.

A-frame 430 includes an arm connector unit 432 which includes pins thereon for receiving the forward extension arms 404, 406 of the extension module 400, as shown by dotted lines in FIG. 20. The torque module frame 434 is configured to support torque module 200 and includes a set of spring cartridges 436 extending vertically upward from the torque module frame 434; the spring cartridges 436 are designed to support the suspension frame 101 which in turn suspends spinner module 100 there beneath.

Figure 21:
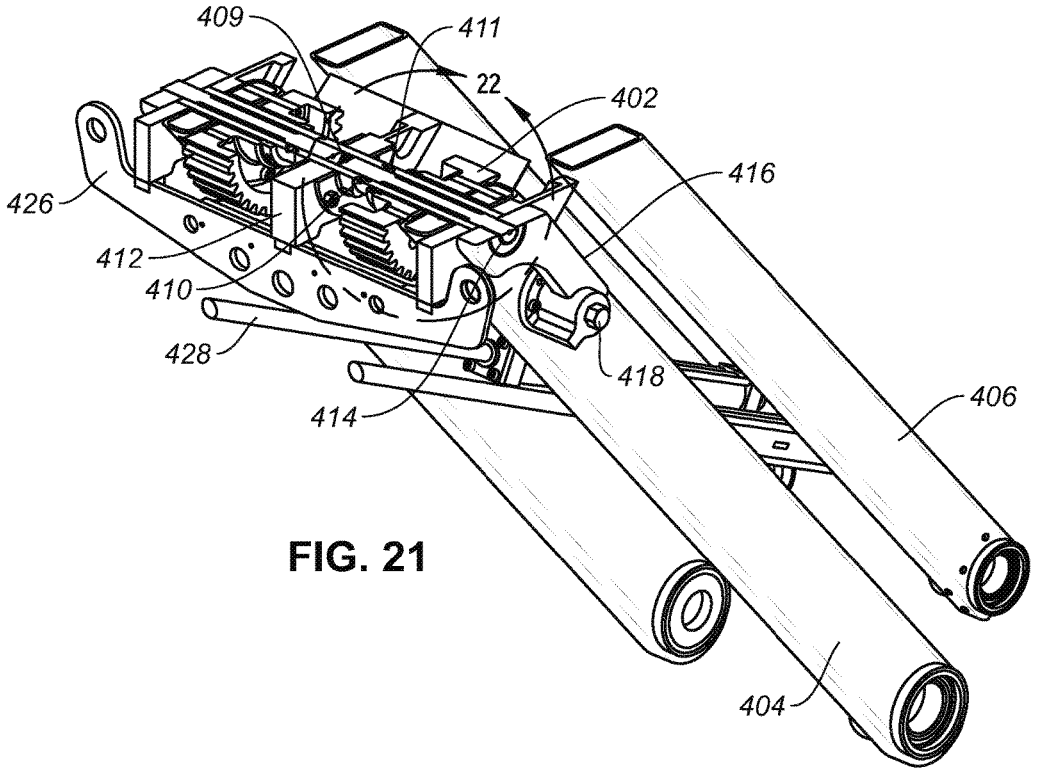
FIG. 21 is a cross-section of part of the extension module of FIG. 19.
Figure 22:
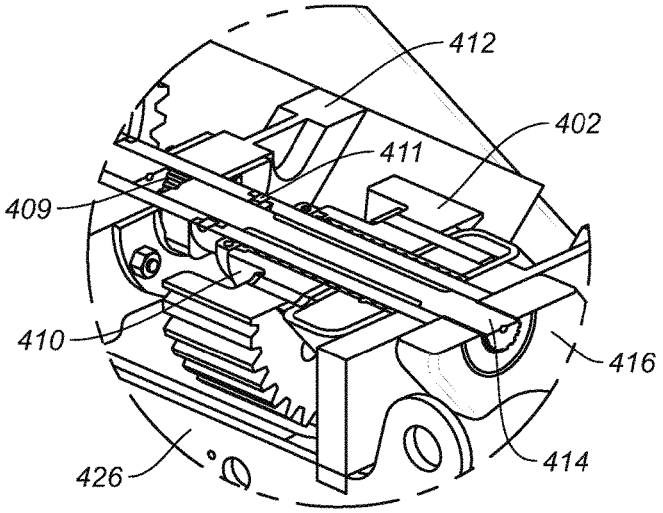
FIG. 22 is an enlarged view of DETAIL A from FIG. 21.

FIG. 21 is a cross-section of part of the extension module of FIG. 19 showing selected components of the rear half of the extension module 400 aft of the center brace 426, and FIG. 22 is an enlarged view of DETAIL A from FIG. 21. Referring to FIGS. 21 and 22, the significance of the use of torsion rods 414 is described in further detail. The torsion rod 414 is sheathed within a hollow shaft 410 as has a fixed end secured by pins 411 against a splined hub 409. The torsion rod 414 within its hollow shaft 410 extends through timing gear 402 and inner extension arm 404 to terminate at lever arm 416. The torsion rod 414 rotates at the lever arm end (with extension of the extension module 400), and as it is fixed at the other end it fights this rotation with a retraction force imparted thereby. The lever arm 416 has an eccentric shaft 418 at a lower end thereof; this acts to preload the torsion rod 414 with torque. Thus, the amount of preload on the ends of the torsion rods 414 can be adjusted by rotating the eccentric shaft 418, so that the extension arms 404, 406 of the extension module 400 extend from a retracted position with only between about 100 to 400 lbs. of force.

The torsion rods 414 allow the module 400 to be extended with only 100 to 400 lbs of force. Due to the weight of the spinner and the torque modules 100, 200, the extension module 400 wants to extend. This is true for all designs. The further it extends the more force it takes to bring it back. The torsion rods 414 are like springs, they apply a counter or retraction force as they are rotated due to extension of the inner extension arm 404 (along with its outer extension arm 406) outward. The more the forward and rearward extension arms 404, 406 of the extension module 400 extend, the greater the retraction force the torsion rods 414 apply to counter the extension force.

By doing this, the extension force and the retraction force stays constant. Each torsion rod 414 is connected at its distal end to an eccentric shaft 418 that can be adjusted to change this retraction force. The preload applied by the eccentric shaft 418 can be adjusted from 0 to 600 lbs of force that is trying to keep the extension module 400 closed, no matter where it is in its extension range. No other extension unit has this; conventional roughnecks use very large hydraulic cylinders to move the extension unit in or out. The above design is safer and allows for the use of much smaller extension cylinders 428 to do the same job. The design has a safety factor of 6; any one torsion rod 414 can support the extension function by providing a counter closing force.

Accordingly, the example iron roughneck system 10 employs a hydraulic power rotation system, unlike the manual control of conventional iron roughneck systems which put operators in harm's way. There is included an interlock system that prevents the operator from doing multiple functions at the same time. The example iron roughneck system has a hydraulic over hydraulic logic system. This uniquely designed system interlocks the torque functions and prevents the operator from putting himself or the roughneck system 10 at risk. The logic system will only allow the operator to perform functions in the correct order. The operator console 500 has visual indicators that show the operator what function they are currently doing on console 500 in front of him. The visual indicators tell the operator the current function, locked out functions and available functions.

The example iron roughneck system 10 provides for a modular design of the spinner module 100 and torque module 200 that allows for ease of removal and replacement of any one module quickly, minimizing maintenance and down time. The modular design also allows the system 10 to be run with the spinner and/or torque modules 100, 200 removed independently. The modular design also allows for the spinner module 100 and torque module 200 to be removed and repaired off of the rig floor, allowing drilling operations to continue.

The example iron roughneck system employs sealed bearings and double seal o-rings to maintain a permanently greased environment to keep contaminates out. This provides a zerk-free maintenance platform. Additionally, a centering device 207 in the torque module 200 is configured for automatically self centering of the spinner module 100 and torque module 200 via the extension module 400 on or around the drill pipe; this allows the operator to be able to stand clear of the roughneck system 10, unlike conventional roughnecks in which the pipe has to be manually centered within a torque device. The operator is thus safely outside of the hazard zone running the system 10 remotely at operator console 500, at a safe distance.

The system 10 is configured to automatically adjust from one diameter pipe size to another. The operator does not have to do anything. This saves time during the drilling process. Specifically, the pipe clamp fingers 220 and clamp cylinders 210 of torque module 200 cooperate to adapt to slip or drill collar devices or a pipe handling system and automatically adjust from one diameter pipe to another different diameter pipe. This substantially saves time and minimizes the number of systems and personnel required.

Accordingly, the iron roughneck system includes a replaceable spinner module designed to automatically handle pipe having a diameter from 3½" to 10" and being self diameter adjusting and self-positioning on the drill pipe, a replaceable torque module designed to automatically handle pipe self adjusting to pipe diameters from 4" to 10", a base module with powered left/right rotation, and an extension module providing a flat horizontal extension trajectory from fully retracted out to a extended range of 10 feet. Each of the modules further incorporates or employs the use of double-sealed bearings and o-rings with no zerks so as to be impervious to salt exposure.

The example embodiments being thus described, it will be obvious that the same may be varied in many ways. Such variations are not to be regarded as departure from the example embodiments, and all such modifications as would be obvious to one skilled in the art are intended to be included in the following claims.

I claim:

1. An automated roughneck system, comprising:

a base module, a removable spinner module for spinning pipe in connect or disconnect drill pipes at threaded interfaces, the spinner module configured to automatically self-center itself around a drill pipe and to automatically adjust to a varied range of drill pipe diameters, a removable torque module for torqueing drill pipe, the torque module including a centering device which automatically senses drill pipe of varied diameters and moves around the drill pipe until the spinner module and torque module are centered on the drill pipe, an extension module connected between the base module and the spinner and torque modules, the extension module including a plurality of arms adapted to be extended therefrom and retracted thereto so as to move the spinner and torque modules toward and away from the base module, wherein each of the base, spinner, torque and extension modules are remotely controlled.

2. The system of claim 1, wherein the spinner module includes a pair of roller block assemblies arranged in opposite facing relation to one another with an opening there between for receiving drill pipe vertically therethrough, each roller block assembly laterally movable under hydraulic power into and out of the opening so as to accommodate drill pipes with varied diameters, each roller block assembly including a tandem pair of hydraulically-powered rollers in adjacent relation to one another, the opposed pairs of rollers configured to engage drill pipes of varied diameters on opposite sides thereof as the opposed roller block assemblies move inward toward one another for pipe spinning and clamping operations.

3. The system of claim 1, wherein the spinner module includes two pairs of hydraulically-powered rollers for spinning and clamping a drill pipe, each roller pair including two rollers in adjacent relation to one another, each roller pair in opposed relation to the other across an opening in the spinner module between the two roller pairs and to which a pipe is to be vertically received therethrough, the opposed roller pairs configured to move laterally inward into the opening and toward the pipe from opposite sides to apply a clamping force on the pipe, the roller pairs adapted to move around the pipe so as to center the pipe directly between the opposed pairs of rollers, with the pipe automatically centered between the opposed pairs of rollers once the rollers have applied a maximum clamping force.

4. The system of claim 1, wherein the spinner module includes a plurality of hydraulically-powered rollers for spinning and clamping drill pipe, each roller including a roller replacement indicator thereon to determine when roller replacement is required.

5. The system of claim 1, wherein the spinner module is configured to automatically adjust to pipe diameters in a range of between 3½ inches to 10 inches.

6. The system of claim 1, wherein the spinner module is configured to apply a maximum spinning torque to a drill pipe of up to 3,000 ft-lbs, and a maximum clamping force to a drill pipe of up to 25,000 lbs.

7. The system of claim 1, wherein the torque module includes at least two clamp cylinders, each in opposed facing relation to the other, with an opening provided through the torque module and between the opposed clamp cylinders to accommodate a drill pipe vertically therethrough, each clamp cylinder including a front block laterally movable into and out of the opening via a piston action provided to it by a piston cylinder within the clamp cylinder, each front block having a set of pipe grip fingers affixed thereto for engaging the pipe in the opening, wherein the set of pipe grip fingers include fingers that pivot or articulate around a portion of pipe as the front block moves laterally into the opening to push the set of pipe grip fingers onto and around the pipe, with the opposed sets of pipe grip fingers on either side of the pipe configured to apply a uniform gripping load around the pipe.

8. The system of claim 7, wherein the two sets of opposed pipe grip fingers, one set on either side of the pipe, automatically adjust to accommodate a varied diameter of drill pipe, and apply a total of six points of uniform, distributed load around the pipe.

9. The system of claim 1, wherein the torque module is configured to automatically adjust to accommodate pipe diameters in a range of between 4 inches to 10 inches.

10. The system of claim 1, wherein the torque module further comprises a rotatable upper torque head that is configured to rotate up to 52 degrees clockwise or counter-clockwise from a neutral position.

11. The system of claim 10, wherein the upper torque head includes:

a pair of clamp cylinders in opposed facing relation to one another, each clamp cylinder having a set of pipe grip fingers attached thereto that are configured to laterally move into an opening provided between the opposed clamp cylinders so as to apply a uniform distributed load around a portion of drill pipe provided in the opening, and a semi-circular, torque gear attached to the clamp cylinders, the torque gear configured to be engaged by a plurality of driving gears supported in a gearbox of the torque module and driven by a pair of hydraulic motors to rotate the upper torque head via the torque gear.

12. The system of claim 1, wherein the base module is configured for powered rotation in either direction and includes:

a vertical displacement cage having a bushing at a lower end thereof to which is connected the lower ends of the paired sets of rearward extension arms of the extension module, and a lifting cylinder to raise and lower the vertical displacement cage along a center column so as to provide coarse vertical height adjustment for the system.

13. The system of claim 1, further comprising:

an operator control console remote from the roughneck system, wherein the base module includes a hydraulic control box attached thereto which contains hydraulic system control components and safety interlocks of the system therein, and the operator console includes a plurality of control levers that provide remote hydraulic control of corresponding control valves and control components designed to operate each of the spinner module, torque module, base module, and extension module, and control of safety interlocks within the hydraulic control box.

14. The system of claim 1, wherein the extension module further includes:

a central hub, two paired sets of forward extension arms, each pair of forward extension arms in spaced relation to the other on opposite sides of the central hub, with upper ends of the paired sets of forward extension arms connected to the central hub and lower ends of the paired sets of forward extension arms connected to supporting structure that supports the spinner module and torque module thereon, and two paired sets of rearward extension arms, each pair of rearward extension arms in spaced relation to the other on opposite sides of the central hub, with upper ends of the paired sets of rearward extension arms connected to the central hub and lower ends of the paired sets of rearward extension arms connected to the base module.

15. The system of claim 14, wherein the central hub includes a plurality of timing gears therein that interact with selected extension arms of the forward and rearward extension arms to cause the paired sets of forward and rearward extension arms to remain at the same angle of travel relative to each other and to move at the same rate throughout their range of extension, so that the extension module extends and retracts in a piston-like fashion, parallel to a ground surface.

16. The system of claim 14, Wherein the central hub of the extension module includes a plurality of elongate torsion rods therein having first and second ends, the first ends of the torsion rods fixed within the central hub and each of the second ends of the torsion rods extending through corresponding apertures in selected extension arms and captured in an aperture provided in an upper part of a corresponding lever arm, a lower part of the lever arm attached to an external side surface of a selected extension arm, the second ends of the torsion rods in the lever arms rotating as the paired sets of forward and rearward extension arms extend, so as to impart a retraction force that is counter to an extension force imparted by the paired sets of forward and rearward extension arms extending under load of the spinner and torque modules.

17. The system of claim 16, wherein the torsion rods limit the amount of extension force required so that the extension arms of the extension module extend from a retracted position with only 100 to 400 lbs. of force, depending on a torque preload value applied to the torsion rods' second ends.

18. The system of claim 14, wherein the supporting structure connected to lower ends of the paired sets of forward extension arms includes an A-frame structure to which the lower ends are connected thereto at a rear side thereof, a torque module frame attached at a front side of the A-frame structure for supporting the torque module thereon, the torque module frame supporting a plurality of spring cartridges in spaced relation to one another thereon, the spring cartridges extending vertically upward from the torque module frame, the spring cartridges configured to support a suspension frame at upper ends thereof, the suspension frame in turn configured to suspend the spinner module there from, with the spinner module suspended directly above the torque module.

19. The system of claim 18, wherein the spinner module as connected to the suspension frame is configured to move or flex in a plurality of directions to assist in centering the spinner module on a pipe.

20. The system of claim 14, wherein the spinner module, as supported on the supporting structure attached to the forward extension arms, is configured to flex and move so as to assist in self-centering the spinner module around a pipe.

21. An automated roughneck system, comprising:

a base module, a removable spinner module for spinning pipe to connect or disconnect drill pipes at threaded interfaces, the spinner module configured to automatically self-center itself around a drill pipe and to automatically adjust to a varied range of drill pipe diameters, the spinner module including:

a pair of roller block assemblies arranged in opposite facing relation to one another with an opening there between for receiving drill pipe vertically therethrough, each opposed roller block assembly laterally movable in unison into the opening under hydraulic power toward one another for pipe spinning and clamping operations and out of the opening away from each other, a removable torque module for torqueing drill pipe to make-up or break-out the pipe, the torque module including a centering device which automatically senses drill pipe of varied diameters and moves around the drill pipe until the spinner module and torque module are centered on the drill pipe, an extension module connected between the base module and the spinner and torque modules, the extension module including a plurality of arms adapted to be extended therefrom and retracted thereto so as to move the spinner and torque modules toward and away from the base module, wherein each of the base. spinner, torque and extension modules are remotely controlled.

22. The system of claim 21, wherein the extension module further includes:

a first plurality of extension arms that extend from a central hub of the extension module to connect to the base module, and a second plurality of extension arms that extend from the central hub to connect to supporting structure that supports the spinner and torque modules thereon.

23. The system of claim 21, wherein each roller block assembly includes a tandem pair of hydraulically-powered rollers in adjacent relation to one another, the opposed pairs of rollers configured to engage drill pipes of varied diameters on opposite sides thereof as the opposed roller block assemblies move inward into the opening.

24. An automated roughneck system, comprising:

a base module, a removable spinner module for spinning pipe to connect or disconnect drill pipes at threaded interfaces, the spinner module configured to automatically self-center itself around a drill pipe and to automatically adjust to a varied range of drill pipe diameters, a removable torque module for torqueing drill pipe to make-up or break-out the pipe, the torque module configured to automatically self-center itself around a drill pipe and to automatically adjust to a varied range of drill pipe diameters, the torque module including:

at least two clamp cylinders, each in opposed facing relation to the other, with an opening provided through the torque module and between the opposed clamp cylinders to accommodate a drill pipe vertically therethrough, each clamp cylinder including a front block laterally movable into and out of the opening via a piston action provided to it by a piston cylinder within the clamp cylinder, each front block having a set of pipe grip fingers affixed thereto for engaging the pipe in the opening, wherein the set of pipe grip fingers include fingers that pivot or articulate around a portion of pipe as the front block moves laterally into the opening to push the set of pipe grip fingers onto and around the pipe, with the opposed sets of pipe grip fingers on either side of the pipe configured to apply a uniform gripping load around the pipe an extension module connected between the base module and the spinner and torque modules, the extension module including a plurality of arms adapted to be extended therefrom and retracted thereto so as to move the spinner and torque modules toward and away from the base module, wherein each of the base spinner, torque and extension modules are remotely controlled.

25. The system of claim 24, wherein the extension module further includes:

a first plurality of extension arms that extend from a central hub of the extension module to connect to the base module, and a second plurality of extension arms that extend from the central hub to connect to supporting structure that supports the spinner and torque modules thereon.

* * * * *